US009971263B2

(12) United States Patent
Fukudome et al.

(10) Patent No.: US 9,971,263 B2
(45) Date of Patent: May 15, 2018

(54) TONER

(71) Applicant: CANON KABUSHIKI KAISHA, Tokyo (JP)

(72) Inventors: Kosuke Fukudome, Tokyo (JP); Shuhei Moribe, Mishima (JP); Koji Nishikawa, Susono (JP); Daisuke Yoshiba, Suntou-gun (JP); Shotaro Nomura, Suntou-gun (JP); Atsuhiko Ohmori, Yokohama (JP); Sho Kimura, Mishima (JP); Katsuhisa Yamazaki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/393,340

(22) Filed: Dec. 29, 2016

(65) Prior Publication Data

US 2017/0199475 A1 Jul. 13, 2017

(30) Foreign Application Priority Data

Jan. 8, 2016 (JP) ..... 2016-002481

(51) Int. Cl.

*G03G 9/083* (2006.01)
*G03G 9/087* (2006.01)
*G03G 9/08* (2006.01)

(52) U.S. Cl.

CPC ..... *G03G 9/0833* (2013.01); *G03G 9/0819* (2013.01); *G03G 9/0821* (2013.01); *G03G 9/0827* (2013.01); *G03G 9/0837* (2013.01); *G03G 9/0838* (2013.01); *G03G 9/0839* (2013.01); *G03G 9/08711* (2013.01); *G03G 9/08755* (2013.01); *G03G 9/08784* (2013.01)

(58) Field of Classification Search

CPC .. G03G 9/0837; G03G 9/0839; G03G 9/0833; G03G 9/0832; G03G 9/0831; G03G 9/0834; G03G 9/083; G03G 9/0838; G03G 9/0821; G03G 9/08784; G03G 9/08786; G03G 9/08788

USPC ..... 430/106.1, 106.2

See application file for complete search history.

(56) References Cited

U.S. PATENT DOCUMENTS 5,858,532 A * 1/1999 Kozawa ..... B82Y 30/00 428/402
6,875,549 B2 4/2005 Yamazaki et al.
6,881,527 B2 4/2005 Moribe et al.
7,267,919 B2 9/2007 Moribe et al.
7,273,686 B2 9/2007 Onuma et al.
7,288,354 B2 10/2007 Moribe et al.
7,351,509 B2 4/2008 Moribe et al.
7,422,832 B2 9/2008 Ogawa et al.
7,537,877 B2 5/2009 Yoshiba et al.
7,544,455 B2 * 6/2009 Yoshiba ..... G03G 9/0821 430/106.2
7,582,401 B2 9/2009 Ogawa et al.
7,638,251 B2 12/2009 Yamazaki et al.
7,700,254 B2 4/2010 Moribe et al.
7,740,998 B2 6/2010 Yamazaki et al.
7,745,089 B2 6/2010 Okubo et al.
7,796,926 B2 9/2010 Matsuda et al.
7,855,042 B2 12/2010 Kobori et al.
7,897,316 B2 3/2011 Yamazaki et al.
8,026,030 B2 9/2011 Moribe et al.
8,057,977 B2 11/2011 Moribe et al.
8,227,162 B2 7/2012 Sano et al.
8,426,094 B2 4/2013 Magome et al.
8,501,377 B2 8/2013 Takahashi et al.
8,512,925 B2 8/2013 Moribe et al.
8,614,044 B2 12/2013 Matsui et al.
8,778,585 B2 7/2014 Matsui et al.
8,852,839 B2 10/2014 Chonan et al.
8,883,389 B2 11/2014 Matsui et al.
9,034,549 B2 5/2015 Shiotari et al.
9,040,216 B2 5/2015 Fukudome et al.
9,097,997 B2 8/2015 Nomura et al.
9,097,998 B2 8/2015 Yamazaki et al.
9,116,448 B2 8/2015 Terauchi et al.
9,128,400 B2 9/2015 Takahashi et al.
9,134,637 B2 9/2015 Hotta et al.
9,141,012 B2 9/2015 Moribe et al.
9,152,065 B2 10/2015 Sano et al.
9,201,323 B2 12/2015 Nishikawa et al.
9,213,250 B2 12/2015 Nomura et al.
9,213,251 B2 12/2015 Ohmori et al.
9,217,943 B2 12/2015 Matsui et al.
9,239,528 B2 1/2016 Hasegawa et al.
9,250,548 B2 2/2016 Nomura et al.
9,256,148 B2 2/2016 Fujikawa et al.
9,261,804 B2 2/2016 Yamazaki et al.

(Continued)

FOREIGN PATENT DOCUMENTS

JP H10-182163 7/1998
JP 2002-278146 9/2002
JP 2014-080515 5/2014

OTHER PUBLICATIONS

U.S. Appl. No. 15/259,293, filed Sep. 8, 2016, Yoshitaka Suzumura.

*Primary Examiner* — Janis L Dote

(74) *Attorney, Agent, or Firm* — Fitzpatrick Cella Harper and Scinto

(57) ABSTRACT

Provided is a toner having a toner particle that contains a binder resin and a magnetic particle, wherein the magnetic particle satisfies the following stipulations (i) to (iii): (i) the magnetic particle has a prescribed shape and has a protruded portion on a plane portion thereof, (ii) the magnetic particle has a core particle that contains magnetite and has a coating layer, and (iii) the coating layer contains an iron-containing oxide and at least one of a silicon-containing oxide and an aluminum-containing oxide. In a molecular weight distribution measured on the tetrahydrofuran-soluble matter of the toner, the ratio (Mw/Mn) of a weight-average molecular weight to a number-average molecular weight is at least 10.0.

10 Claims, 4 Drawing Sheets

(56) References Cited

U.S. PATENT DOCUMENTS

| | | | |
|---|---|---|---|
| 9,261,806 | B2 | 2/2016 | Moribe et al. |
| 9,285,697 | B2 | 3/2016 | Fukudome et al. |
| 9,304,422 | B2 | 4/2016 | Matsui et al. |
| 9,341,970 | B2 | 5/2016 | Yoshiba et al. |
| 9,348,246 | B2 | 5/2016 | Magome et al. |
| 9,354,545 | B2 | 5/2016 | Matsui et al. |
| 9,442,416 | B2 | 9/2016 | Magome et al. |
| 9,470,993 | B2 | 10/2016 | Nishikawa et al. |
| 2004/0110076 | A1 | 6/2004 | Yamazaki et al. |
| 2013/0252167 | A1 | 9/2013 | Moribe et al. |
| 2013/0309603 | A1 | 11/2013 | Takahashi et al. |
| 2014/0004460 | A1 | 1/2014 | Yoshiba et al. |
| 2015/0037719 | A1 | 2/2015 | Naka et al. |
| 2015/0125790 | A1 | 5/2015 | Hotta et al. |
| 2015/0185658 | A1 | 7/2015 | Wakabayashi et al. |
| 2015/0220013 | A1 | 8/2015 | Nishikawa et al. |
| 2016/0041481 | A1 | 2/2016 | Nomura et al. |
| 2016/0041484 | A1 | 2/2016 | Tsuda et al. |
| 2016/0070192 | A1 | 3/2016 | Terauchi et al. |
| 2016/0091809 | A1 | 3/2016 | Tsuda et al. |
| 2016/0091813 | A1 | 3/2016 | Yoshiba et al. |
| 2016/0139522 | A1 | 5/2016 | Yoshiba et al. |
| 2016/0161874 | A1 | 6/2016 | Yamazaki et al. |
| 2016/0202624 | A1 | 7/2016 | Nishikawa et al. |

* cited by examiner

TONER

BACKGROUND OF THE INVENTION

Field of the Invention

The present invention relates to a toner used in, for example, electrophotographic methods, electrostatic recording methods, and magnetic recording methods.

Description of the Related Art

Developing systems that use a magnetic single-component developer containing a magnetic toner have been aggressively used in black-and-white image-forming apparatuses (copiers and laser beam printers).

Magnetic single-component developers support a simpler developing system than those in case of two-component developers and nonmagnetic single-component developers and are thus advantageous with regard to size reduction and cost reduction.

In response to the growing awareness of promoting efficiency in the office, the demands on black-and-white image-forming apparatuses are growing more diverse and the level of these requirements is also increasing.

Specifically, responses are being required to demands for running cost reductions, less maintenance, smaller sizes, higher speeds, better energy savings, and support for media diversity.

For example, increasing the toner fill amount per toner cartridge unit can be contemplated in order to lower the running costs and reduce maintenance.

On the other hand, reducing the size of the image-forming apparatus requires a reduction in the toner fill volume in the toner cartridge and a reduction in the size of components such as the developing sleeve.

In order for size reduction and the toner fill amount—which are in conflict as indicated above—to co-exist, investigations are underway into high fill density cartridges, which have increased toner fill densities, but at present there are still many problems.

Reducing the amount of heat during fixing of the toner to paper is effective for responding to higher speeds for an image-forming apparatus as well as responding to greater energy savings, and there is demand for the development of toner that can be fixed to paper at ever lower temperatures (improved low-temperature fixability, i.e., a lower fixation temperature lower limit).

Viewed from the perspective of supporting various media, there is demand for a toner that resists hot offset even when large amounts of heat are applied to the toner during fixing by using high temperatures for fixing unit temperature control or lowering the print speed (improved hot offset resistance, i.e., a higher fixation temperature upper limit).

Based on these considerations, there is demand for a toner that has a wider temperature interval between the fixation temperature lower limit and the fixation temperature upper limit, i.e., that has a broader fixing margin.

It is known that a certain effect with regard to broadening the fixing margin is obtained by establishing a broader molecular weight distribution for the binder resin incorporated in a toner (Japanese Patent Application Laid-open No. 2014-80515).

With regard to magnetic toner that contains magnetic particles, Japanese Patent Application Laid-open No. 2002-278146 and Japanese Patent Application Laid-open No. H10-182163 propose that an improved toner performance, e.g., developing performance and so forth, be brought about by improving the magnetic particles.

SUMMARY OF THE INVENTION

Japanese Patent Application Laid-open No. 2014-80515 proposes a toner that, through a low molecular weight component, can lower the fixation temperature lower limit because the binder resin melts beginning at low temperatures, and that, through a high molecular weight component, can provide a high fixation temperature upper limit because a high viscosity can then be maintained by the binder resin even in high-temperature regions.

However, just controlling the molecular weight distribution has had a limited effect with regard to improving the low-temperature fixability.

In addition, a decline in the image quality tended to readily occur when toner containing binder resin with such a broad molecular weight distribution was subjected to long-term holding in a harsh high-temperature, high-humidity environment (40° C., 95% RH).

In particular, in the case of a cartridge structure having a high fill density and a small-diameter sleeve as indicated above, the image quality tended to decline, i.e., a white speck defect was produced in the halftones, when printing was performed after standing in a high-temperature, high-humidity environment (decline in image quality after standing under harsh conditions).

On the other hand, with a toner that contains a binder resin that has a broad molecular weight distribution, bringing about an increase in image quality has been quite difficult—even using the magnetic particles described in Japanese Patent Application Laid-open No. 2002-278146 and Japanese Patent Application Laid-open No. H10-182163—when a high fill density cartridge has been held in a high-temperature, high-humidity environment, and there is still room for additional improvements.

The present invention provides a toner that solves the problems identified above.

That is, the present invention provides a toner that exhibits an excellent low-temperature fixability, a broad fixing margin, and an excellent image quality after standing under harsh conditions.

The present invention relates to a toner that has a toner particle that contains a binder resin and a magnetic particle, wherein the magnetic particle satisfies all of the stipulations (i) to (iii) below:

(i) the magnetic particle has an octahedral shape or an octahedron-like shape and has a protruded portion on a plane portion thereof, (ii) the magnetic particle has a core particle that contains magnetite and has a coating layer 1 provided on a surface of the core particle, and (iii) the coating layer contains an iron-containing oxide and at least one selected from the group consisting of a silicon-containing oxide and an aluminum-containing oxide, and in a molecular weight distribution measured on the tetrahydrofuran (THF)-soluble matter of the toner using gel permeation chromatography (GPC), the ratio (Mw/Mn) of a weight-average molecular weight (Mw) to a number-average molecular weight (Mn) is at least 10.0.

The present invention, can thereby provide a toner that exhibits an excellent low-temperature fixability, a broad fixing margin, and an excellent image quality after standing under harsh conditions.

Further features of the present invention will become apparent from the following description of exemplary embodiments (with reference to the attached drawings).

DESCRIPTION OF THE EMBODIMENTS

Figure 1A:
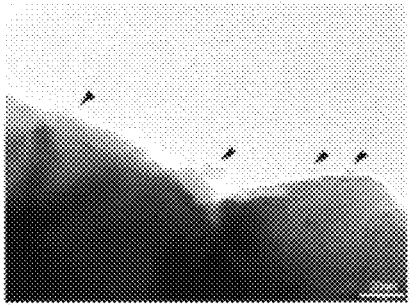
FIGS. 1A and 1B are TEM photographs of magnetic particles used in the examples (photographs in lieu of drawings)

Unless specifically indicated otherwise, the phrases "at least XX and not more than YY" and "XX to YY" that specify numerical value ranges indicate in the present invention numerical value ranges that include the lower limit and upper limit given as end points.

The present inventors carried out focused investigations, with regard to black-and-white image-forming apparatuses, into toner that would have an excellent low-temperature fixability, a broad fixing margin, and an excellent image quality even after standing under harsh conditions.

However, simply improving the binder resin in accordance with conventional thinking could not bring about improvements in the image quality in the case of a high fill density cartridge after standing under harsh conditions. In addition, there were also limitations with regard to improving the low-temperature fixability.

Investigations were therefore first carried out in order to explore the factors that lower the image quality in the case of a high fill density cartridge after standing under harsh conditions.

As a result, it was found that aggregation clumps of the toner are a factor that lowers the image quality and that the aggregation clumps are in a consolidated state and are produced by standing in a harsh high-temperature, high-humidity environment.

These aggregation clumps were not complete blocking clumps but were clumps in which a relatively highly adhesive toner was more loosely aggregated.

Additional investigations were carried out, and it was found that, in particular for a toner particle containing a binder resin having a large Mw/Mn and thus a broad molecular weight distribution, uniform mixing between the low molecular weight component and high molecular weight component is difficult to achieve and as a result the low molecular weight component readily segregates to the toner particle surface.

This was found to promote the formation of aggregation clumps in high fill density cartridges. As a consequence, the present inventors thought that it would be necessary to improve the mixability between the low molecular weight component and the high molecular weight component in the toner particle.

Attempts were first made to improve the kneading conditions during the toner particle production process, but the effects were limited and it was difficult to improve the image quality after the high fill density cartridge had been held under harsh conditions.

In addition, the shear force and shear-generated heat caused by strong kneading caused a decline in the molecular weight of the high molecular weight component, and an undesirable effect of this was a narrowing of the fixing margin.

Thus, looking at this from a different perspective, the idea was conceived of improving the dispersibility of the low molecular weight component in the toner particle using the other constituent materials of the toner.

It was discovered that, through the incorporation of a specific magnetic particle, the dispersibility of the low molecular weight component in the toner particle could be substantially improved without negatively affecting the other properties, and an excellent image quality was thereby achieved even when the toner was held under harsh conditions in a high fill density cartridge.

In addition, it was discovered that an excellent low-temperature fixability could also be provided by having such a toner structure, and the present invention was achieved based on this discovery.

That is, the toner of the present invention is a toner that has a toner particle that contains a binder resin and a magnetic particle, wherein the magnetic particle satisfies all of the stipulations (i) to (iii) below:

(i) the magnetic particle has an octahedral shape or an octahedron-like shape and has a protruded portion on a plane portion thereof, (ii) the magnetic particle has a core particle that contains magnetite and has a coating layer provided on a surface of the core particle, and (iii) the coating layer contains an iron-containing oxide and at least one selected from the group consisting of a silicon-containing oxide and an aluminum-containing oxide, and in a molecular weight distribution measured on the tetrahydrofuran (THF)-soluble matter of the toner using gel permeation chromatography (GPC), the ratio (Mw/Mn) of a weight-average molecular weight (Mw) to a number-average molecular weight (Mn) is at least 10.0.

The dispersibility of the low molecular weight component in the toner particle is enhanced because the toner has this constitution, which makes it possible to satisfy all of the following: the low-temperature fixability, enlargement of the fixing margin, and the image quality after standing in a harsh environment.

The reason for the ability to enhance the dispersibility of the low molecular weight component in the toner particle is hypothesized to be due to the following two effects.

The first effect results from the ability of the surface of the magnetic particle to support the low molecular weight component in the binder resin because this surface has a high affinity for this low molecular weight component (supporting effect).

This effect is hypothesized to be produced by the following factors:

the magnetic particle has a microscopic unevenness in its surface due to the presence of the protruded portion on the plane portions of the octahedron, and the magnetic particle has a coating layer that contains a specific oxide as described below.

The second effect is the ability to enhance the dispersibility of the magnetic particle in the toner particle because the magnetic particle has an octahedral shape or an octahedron-like shape and has a protruded portion on a plane portion thereof (dispersing effect).

Magnetic particles are generally obtained by producing a fine particle by oxidizing the iron ion, e.g., from iron sulfate, in water and then carrying out a surface treatment, drying, and a pulverization treatment. The produced magnetic particles exhibit high magnetic and physical cohesive forces and as a consequence the magnetic particles are frequently present as aggregates.

In contrast to this, it is thought that in the present invention, due to the protruded portion present on the plane portions of the magnetic particle, the magnetic particles assume pointwise contact rather than surface contact and as a consequence self-aggregation of the magnetic particles can be suppressed.

In addition, it is thought that the protruded portions form a frictional resistance and cause an increase in the frictional force between the melted resin and the magnetic particle, and that as a result break up of the magnetic particle aggregation clumps is facilitated during the toner particle production process, e.g., the kneading step.

It is further hypothesized that self-aggregation of the magnetic particles is also suppressed due to the aforementioned supporting effect; that the magnetic particle dispersing effect is increased due to their synergetic interaction; and that the dispersibility of the magnetic particles in the toner particle is substantially improved as a result.

This supporting effect and dispersing effect for the magnetic particle results in the low molecular weight component becoming microfinely dispersed in the toner particle in state in which the low molecular weight component is supported at the surface of the magnetic particle.

As a result, the segregation of the low molecular weight component in the toner particle can be suppressed and as a consequence the production of toner aggregation clumps can be suppressed and an excellent image quality can be maintained even for the case of use of a high fill density cartridge and standing under harsh conditions.

The low-temperature fixability of the toner can also be enhanced because the low molecular weight component is supported at the surface of the magnetic particle and is thereby uniformly microfinely dispersed in the toner particle.

Because the uniformly dispersed low molecular weight component instantaneously plasticizes the binder resin during fixing, an excellent low-temperature fixability can be realized even under circumstances in which the amount of heat applied to the toner is low, e.g., high-speed printing, the use of thick paper, and the output of solid black, images.

The magnetic particle satisfies the following stipulations (i) to (iii) in the present invention.

(i) The magnetic particle has an octahedral shape or an octahedron-like shape and has a protruded portion on a plane portion thereof.

When the magnetic particle has an octahedral shape, its magnetic properties and tinting strength are further enhanced and the protruded portions are also easily formed on the plane portions by the treatment described below.

A heretofore known method can be used for the method of controlling the shape of the magnetic particle. An example of a method for giving the magnetic particle an octahedral shape is to bring the pH during the wet oxidation reaction during core particle production to at least 9.

In addition, the magnetic particle has a protruded portion on the plane portion of the octahedron.

As has been described above, the presence of the protruded portion makes it possible for the low molecular weight component to be supported on the magnetic particle surface and thereby enables a uniform dispersion of the low molecular weight component in the toner particle along with the magnetic particle.

When this protruded portion is not present, the dispersibility of the low molecular weight component declines and the low-temperature fixability and the image quality after standing under harsh conditions in the case of use of a high fill density cartridge are reduced.

(ii) The magnetic particle has a core particle that contains magnetite and has a coating layer provided on a surface of the core particle.

(iii) The coating layer contains an iron-containing oxide and at least one of a silicon-containing oxide and an aluminum-containing oxide. In addition, this coating layer preferably contains an iron-containing oxide, silicon-containing oxide, and aluminum-containing oxide.

Insofar as the effects of the present invention are not impaired, the core particle may contain a magnetic body other than magnetite. In addition, the magnetic particle may include a magnetic particle that does not satisfy the stipulations (i) to (iii), again insofar as the effects of the present invention are not impaired.

The magnetic characteristics and the tinting strength of the magnetic particle are unsatisfactory when the core particle does not contain magnetite.

The coating layer may evenly coat the entire surface of the core particle, or coating may be carried out to give a state in which a portion of the core particle surface is exposed. For either coating regime, the coating layer is preferably the outermost layer and the core particle surface is preferably thinly coated.

Specifically, the thickness of the coating layer is preferably at least 1 nm and not more than 50 nm and is more preferably at least 2 nm and not more than 20 nm. The height of the protruded portion described below is not included in the thickness of the coating layer.

The thickness of the coating layer is determined by observing the magnetic particle using a transmission electron microscope (TEM); measuring the thickness of the coating layer at 15 locations; and taking the arithmetic average of the measured values.

There are no particular limitations on the method for forming the coating layer, and a known method may be used. For example, after the magnetite-containing core particle has been produced, a silicon source or aluminum source, e.g., sodium silicate or aluminum sulfate, may be added to an aqueous ferrous sulfate solution and the coating layer containing the prescribed oxide may then be formed on the core particle surface by injecting air while adjusting the pH and temperature of the mixture. In addition, the thickness of the coating layer can be controlled into the indicated range by adjusting, for example, the amount of addition of the aqueous ferrous sulfate solution, sodium silicate, and aluminum sulfate.

Figure 1B:
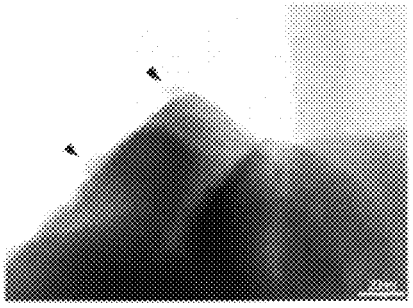

The shape of the magnetic particle can be confirmed using a scanning electron microscope (SEM) as described below. On the other hand, the presence of the protruded portion on the magnetic particle can be confirmed using a transmission electron microscope (TEM), as shown in FIGS. 1A and 1B.

Figure 3:
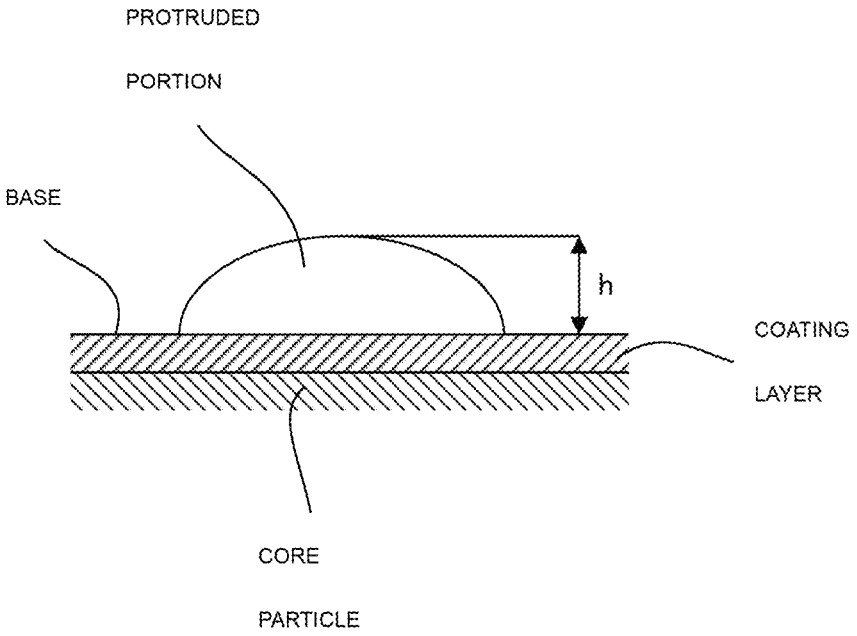
FIG. 3 is a schematic diagram relating to the method for measuring the height of the protruded portion of a magnetic particle.
Figure 4:
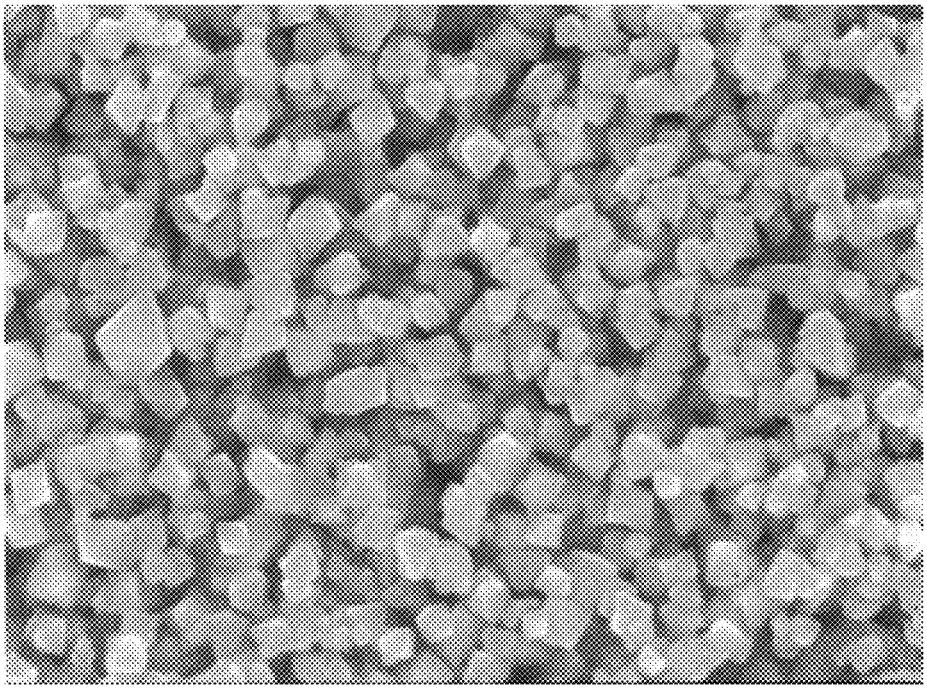
FIG. 4 is an SEM photograph of magnetic particles used in the examples (photograph in lieu of drawing).

The height of the protruded portion, when the magnetic particle is subjected to TEM observation, is the height that protrudes out from the coating layer base. The method for measuring it is as follows: the height h (with the proviso that $h \geq 1$ nm) is measured from the coating layer base to the top of the protruded portion, as shown in FIG. 3, on 15 protruded portions present in the TEM observation image, and the arithmetic average of these measured values is determined.

The height of the protruded portion is preferably at least 1 nm and not more than 40 nm and is more preferably at least 7 nm and not more than 20 nm. Protruded portions may be present without gaps on the coating layer surface or may be sparsely present on the coating layer surface.

Moreover, there are no particular limitations on the number of protruded portions, but one or more should be present per 1 magnetic particle.

The number of these protruded portions and the height of the protruded portion can be controlled into the indicated ranges by adjusting the molar ratio of silicon to iron and the molar ratio of aluminum to iron for the coating layer and the number-average primary particle diameter of the core particle.

In order for the magnetic particle to have a protruded portion on a plane portion of the octahedron, the molar ratio of silicon to iron for the coating layer is preferably at least 0.20 and not more than 1.00 and is more preferably at least 0.30 and not more than 0.90. The molar ratio of aluminum to iron, on the other hand, is preferably at least 0.50 and not more than 2.00 and is more preferably at least 0.50 and not more than 1.80.

According to investigations by the present inventors, a substantial improvement in the low-temperature fixability and in the image quality after standing under harsh conditions was made possible by (1) the coating layer on the magnetic particle containing an iron-containing oxide and at least one of a silicon-containing oxide and an aluminum-containing oxide and (2) the magnetic particle having an octahedral shape or an octahedron-like shape and has a protruded portion on a plane portion thereof.

The affinity between the magnetic particle and the low molecular weight component present in the binder resin declines when the coating layer does not contain an iron-containing oxide or when the coating layer contains neither a silicon-containing oxide nor an aluminum-containing oxide. As a result, the low molecular weight component cannot be supported by the surface of the magnetic particle and the dispersibility of the low molecular weight component in the toner particle then becomes unsatisfactory and the low-temperature fixability and image quality after standing under harsh conditions decline.

Viewed from the perspective of bringing about additional improvements in the dispersibility of the low molecular weight component, the proportions for the silicon, aluminum, and iron present in the coating layer are as follows.

The silicon content in the coating layer, expressed with reference to the total mass of the silicon, aluminum, and iron present in the coating layer, is preferably at least 5.0 mass % and not more than 30.0 mass % and is more preferably at least 7.0 mass % and not more than 20.0 mass %.

The aluminum content in the coating layer, expressed with reference to the total mass of the silicon, aluminum, and iron present in the coating layer, is preferably at least 10.0 mass % and not more than 45.0 mass %, more preferably at least 13.0 mass % and not more than 42.0 mass %, and even more preferably at least 15.0 mass % and not more than 37.0 mass %.

The iron content in the coating layer, expressed with reference to the total mass of the silicon, aluminum, and iron present in the coating layer, is preferably at least 40.0 mass % and not more than 83.0 mass %, more preferably at least 42.0 mass % and not more than 80.0 mass %, and even more preferably at least 44.0 mass % and not more than 78.0 mass %.

Viewed from the perspective of bringing about additional improvements in the low-temperature fixability, the number-average primary particle diameter (D1) of the magnetic particle is preferably at least 50 nm and not more than 200 nm and is more preferably at least 50 nm and not more than 150 nm.

The D1 of the magnetic particle can be controlled through the conditions for synthesis of the magnetic particle. For example, the D1 of the magnetic particle can be adjusted by changing the oxidation reaction time or the air injection rate during core particle production.

Viewed from the perspective of bringing about additional improvements in the low-temperature fixability and the image quality after standing under harsh conditions, the total pore volume of the magnetic particle is preferably at least 0.060 $cm^3/g$ and not more than 0.150 $cm^3/g$ and is more preferably at least 0.063 $cm^3/g$ and not more than 0.100 $cm^3/g$.

A total pore volume for the magnetic particle in the indicated range provides an additional increase in the effect of supporting the low molecular weight component on the magnetic particle and additional improvements in the low-temperature fixability and the image quality after standing under harsh conditions.

This is also preferred because the dispersibility of the magnetic particle in the toner particle is also further improved and image fogging can be inhibited even in print durability testing after standing under harsh conditions.

The total pore volume can be controlled into the aforementioned range not only through the number-average primary particle diameter of the magnetic particle, but also by adjusting the number and height of the protruded portions present on the magnetic particle surface.

From the perspective of the balance between the low-temperature fixability and the tinting strength, the content of the magnetic particle in the present invention is preferably at least 45 mass parts and not more than 100 mass parts and more preferably at least 50 mass parts and not more than 95 mass parts, in each case per 100 mass parts of the binder resin.

In the molecular weight distribution measured by gel permeation chromatography (GPC) on the tetrahydrofuran (THF)-soluble matter in the toner, the ratio (Mw/Mn) of the weight-average molecular weight (Mw) to the number-average molecular weight (Mn) is at least 10.0 in the present invention.

A larger ratio of Mw to Mn (Mw/Mn) indicates a broader molecular weight distribution.

When this Mw/Mn is less than 10.0, a toner is provided in which the molecular weight distribution of the binder resin is then narrow, the low-temperature fixability declines, and the fixing margin is also narrow.

Mw/Mn is preferably at least 10.0 and not more than 70.0 from the standpoint of harmonizing the low-temperature fixability with the fixing margin in good balance.

Mw/Mn is more preferably at least 10.3 and not more than 45.0 and is even more preferably at least 10.5 and not more than 40.0.

Having the molecular weight distribution satisfy the indicated range provides an excellent dispersibility for the low molecular weight component, an even better image quality after standing under harsh conditions, and an excellent dispersibility for the magnetic particles and thereby enables a still better suppression of image fogging even in a print durability test after standing under harsh conditions.

This is hypothesized to be due to the following: by having the molecular weight distribution be in the indicated range, the shear force applied to the magnetic particle in the kneading step is increased and the dispersibility of the magnetic particle and low molecular weight component in the single toner particle is then increased still further.

Mw/Mn can be controlled into the indicated range by, for example, (1) adjusting the Mw/Mn of the binder resin used as a starting material; (2) using two or more binder resins that have different Mw/Mn's and adjusting the ratio between or among these binder resins; and (3) adjusting the kneading temperature or residence time during melt kneading of the resin during, production of the binder resin.

In the present invention, the weight-average molecular weight (Mw) in the molecular weight distribution measured on the tetrahydrofuran (THF)-soluble matter of the toner using gel permeation chromatography (GPC) is preferably at least 10,000 and not more than 1,000,000 and is more preferably at least 20,000 and not more than 400,000.

The number-average molecular weight (Mn), on the other hand, is preferably at least 1,000 and not more than 50,000 and is more preferably at least 2,000 and not more than 10,000.

When Mw and Mn satisfy the indicated ranges, the dispersibility of the magnetic particle is further enhanced and the low-temperature fixability and hot offset resistance of the toner are further improved.

Also in the present invention, the proportion of a component with a molecular weight equal to or less than 1,000 in the molecular weight distribution measured on the tetrahydrofuran (THF)-soluble matter of the toner using gel permeation chromatography (GPC) is preferably at least 3.5 mass % and not more than 15.0 mass %, more preferably at least 3.5 mass % and not more than 12.0 mass % in the THF-soluble matter.

The component with a molecular weight equal to or less than 1,000 is a low molecular weight component, and when the proportion of this component satisfies the indicated range, the dispersibility of the low molecular weight component in the toner particle is improved through the dispersibility-improving effect possessed by the magnetic particle. As a result, even in the case of standing under harsh conditions, the production of aggregation clumps is suppressed particularly well and the low-temperature fixability is particularly well improved.

In the present invention, the content of the resin component insoluble in tetrahydrofuran (THF) (also referred to in the following as the THF-insoluble matter) in the binder resin incorporated in the toner particle is preferably at least 2.0 mass % and not more than 25.0 mass %, more preferably at least 2.3 mass % and not more than 23.0 mass %, and even more preferably at least 2.5 mass % and not more than 20.0 mass %.

The content of the THF-insoluble matter can be controlled into the indicated range by, for example, (1) adjusting the content of the THF-insoluble matter in the binder resin used as a starting material; (2) using two or more binder resins having different THF-insoluble matter contents and adjusting the ratio between or among the binder resins; and (3) adjusting the kneading temperature or residence time during melt kneading of the resin during production of the binder resin.

When the THF-insoluble matter satisfies the indicated range, the magnetic particle dispersibility can be further improved while the low-temperature fixability can co-exist in good balance with the hot offset resistance.

The THF-insoluble matter has a higher elasticity than the other resin components, and as a consequence penetration by the magnetic particle is difficult and this readily causes a reduction in the dispersibility of the magnetic particle. However, a magnetic particle that has a protruded portion shape in the surface in the fine particle contour has an excellent dispersibility and as a result can undergo an excellent dispersion even in the THF-insoluble matter.

The binder resin/used in the toner particle is described in the following.

The resins known for use in toners can be used as the binder resin without particular limitation as long as the aforementioned Mw/Mn when the toner has been produced is at least 10.0.

Examples here are polyester resins, vinyl resins, epoxy resins, and polyurethane resins, while the incorporation of polyester resin is preferred when the low-temperature fixability is considered.

The polyester resin can be exemplified by the condensation polymers of an alcohol component with a carboxylic acid component, and examples of these two components are given in the following.

The alcohol component can be exemplified by the following:

ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, the bisphenol with the following formula I and derivatives thereof, and diols with the following formula II.

(I)

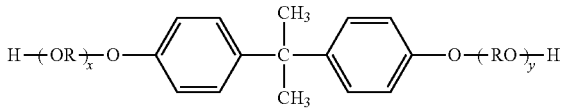

(In the formula, R is an ethylene group or propylene group; x and y are each integers equal to or greater than 0; and the average value of x+y is at least 0 and not more than 10.)

(II)

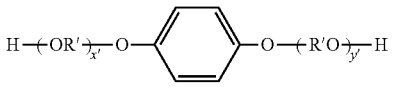

(In the formula, R' is

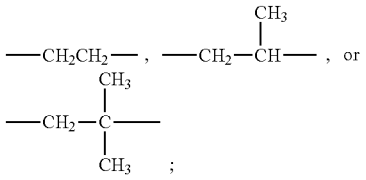

x' and y' are each integers equal to or greater than 0; and the average value of x'+y' is at least 0 and not more than 10.)

The carboxylic acid component can be exemplified by the following:

benzenedicarboxylic acids and their anhydrides, such as phthalic acid, terephthalic acid, isophthalic acid, and phthalic anhydride; alkyl dicarboxylic acids and their anhydrides, such as succinic acid, adipic acid, sebacic acid, and azelaic acid; succinic acid substituted by a $C_{6-18}$ alkyl group or alkenyl group, and anhydrides thereof; unsaturated dicarboxylic acids and anhydrides thereof, such as fumaric acid, maleic acid, citraconic acid, and itaconic acid.

The at least trihydric polyhydric alcohol component can be exemplified by sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

The at least tribasic acid component can be exemplified by trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1, 3-dicarboxy-2-methyl-2-methylenecarboxypropane, tetra(methylenecarboxy)methane, 1,2,7,8-octanetetracarboxylic acid, Empol trimer acid, and anhydrides thereof.

The production of the polyester resin may use a common generally known condensation polymerization method.

On the other hand, the vinyl monomer for production of the vinyl resin or a vinyl polymer segment can be exemplified by the following:

styrene and its derivatives, such as styrene and o-methylstyrene; unsaturated monolefins such as ethylene and propylene; unsaturated polyenes such as butadiene and isoprene; vinyl halides such as vinyl chloride; esters of α-methylene aliphatic monocarboxylic acids, such as methyl methacrylate, n-butyl methacrylate, and 2-ethylhexyl methacrylate; acrylate esters such as n-butyl acrylate and 2-ethylhexyl acrylate; vinyl ethers such as vinyl methyl ether; vinyl ketones such as vinyl methyl ketone; N-vinyl compounds such as N-vinylpyrrole; vinylnaphthalenes; and acrylic acid derivatives and methacrylic acid derivatives, e.g., acrylonitrile.

Additional examples are as follows: unsaturated dibasic acids such as maleic acid and alkenylsuccinic acid; unsaturated dibasic acid anhydrides, such as maleic anhydride and alkenylsuccinic anhydride; esters of unsaturated dibasic acids, such as the methyl half ester of maleic acid and the methyl half ester of alkenylsuccinic acid; α,β-unsaturated acids such as acrylic acid and methacrylic acid; α,β-unsaturated acid anhydrides such as crotonic anhydride and cinnamic anhydride; the anhydride of an α,β-unsaturated acid and a lower fatty acid; and monomers that contain a carboxy group, such as alkenylmalonic acid, alkenylglutaric acid, and alkenyladipic acid, and their anhydrides and monoesters.

Additional examples are acrylate esters and methacrylate esters, such as 2-hydroxyethyl acrylate, and hydroxy group-containing monomers such as 4-(1-hydroxy-1-methylbutyl) styrene and 4-(1-hydroxy-1-methylhexyl)styrene.

The vinyl resin or vinyl polymer segment in the toner of the present invention may have a crosslinked structure provided by crosslinking with a crosslinking agent that has two or more vinyl groups. This crosslinking agent can be exemplified by aromatic divinyl compounds (particularly divinylbenzene) and diacrylate compounds in which linkage is effected by a chain containing an aromatic group and the ether linkage.

This crosslinking agent, with reference to 100 mass parts of the monomer component other than the crosslinking agent, is preferably at least 0.01 mass parts and not more than 10.00 mass parts and is more preferably at least 0.03 mass parts and not more than 5.00 mass parts.

The binder resin may contain a hybrid resin in which a polyester segment is chemically bonded with a vinyl polymer segment.

The hybrid resin may contain, in the vinyl polymer segment and/or polyester segment, a monomer component capable of reacting with both segments.

Among the monomers constituting the polyester segment, monomers capable of reacting with the vinyl polymer segment can be exemplified by the unsaturated dicarboxylic acids and their anhydrides, e.g., fumaric acid, maleic acid, citraconic acid, and itaconic acid.

Among the monomers constituting the vinyl polymer segment, monomers capable of reacting with the polyester segment can be exemplified by those monomers that have a carboxy group or hydroxy group and by acrylic acid, methacrylic acid, and their esters.

With regard to the method for obtaining a conjugate between the vinyl polymer segment and polyester segment, when a polymer is present that contains a monomer component capable of reacting with each of the previously described vinyl polymer segment and polyester segment, a (condensation) polymerization may be run with either segment or with both segments.

In order to facilitate the production of a toner particle that has the previously described molecular weight distribution, the binder resin in the present invention may contain, for example, two or more resins having different softening points or two or more resins having different molecular weight distributions.

The binder resin in the present invention preferably contains a binder resin A that satisfies the following conditions and a binder resin B that satisfies the following conditions.

The softening point (TA) of the binder resin A is preferably at least 75.0° C. and not more than 105.0° C., more preferably at least 80.0° C. and not more than 100.0° C., and even more preferably at least 85.0° C. and not more than 95.0° C.

The softening point (TB) of the binder resin B is preferably at least 115.0° C. and not more than 165.0° C., more preferably at least 120.0° C. and not more-than 160.0° C., and even more preferably at least 125.0° C. and not more than 155.0° C.

By having TA and TB be in the indicated ranges, shear force is then easily applied to the binder resin and magnetic particle during the toner particle production process and the dispersibility of the low molecular weight component and magnetic particle in the single toner particle is made even better.

As a result, the low-temperature fixability is further improved; the fixing margin is made wider; and the image quality after standing under harsh conditions is enhanced.

In addition, by further improving the magnetic particle dispersibility, image fogging can be suppressed even in a print durability test.

Viewed from the standpoint of providing an even better dispersibility of the magnetic particle in the toner particle, the binder resin A preferably has a content of THF-insoluble matter of not more than 3.0 mass %.

From the same standpoint, the binder resin B preferably has a content of THF-insoluble matter of at least 5.0 mass % and not more than 35.0 mass.

From the standpoint of bringing about well-balanced improvements in the low-temperature fixability, fixing margin, and image quality after standing under harsh conditions, the mass ratio of the binder resin A to the binder resin B in the present invention is preferably 15:85 to 85:15, more preferably 20:80 to 80:20, and even more preferably 25:75 to 75:25.

The binder resin A is preferably a polyester resin from the standpoint of improving the low-temperature fixability.

It is hypothesized that the polyester resin, due to its ability to hydrogen bond with the cellulose in paper, facilitates an increase in the adhesiveness.

The binder resin B, on the other hand, is preferably a hybrid resin in which a polyester segment is chemically bonded with a vinyl polymer segment.

This hybrid resin is effective for bringing about additional improvements in the low-temperature fixability and the image quality after standing under a harsh environment.

The improvement in the low-temperature fixability with the hybrid resin is hypothesized to occur because the hybrid resin has a polyester segment and the adhesiveness with paper is then increased.

The improvement in the image quality after standing under harsh conditions, on the other hand, is hypothesized to occur for the following reason: a branched structure in the molecular chain produced by the chemical bonding between the polyester segment and vinyl polymer segment restrains the segregation and aggregation of the low molecular weight component during melt kneading and additional improvements in the dispersibility are then brought about.

The glass transition temperature (Tg) of the binder resin is preferably at least 50.0° C. and not more than 75.0° C. from the standpoint of the storability. The weight-average molecular weight (Mw) of the binder resin is preferably at least 5,000 and not more than 1,000,000 from the standpoint of facile control of Mw/Mn. The number-average molecular weight (Mn) of the binder resin, on the other hand, is preferably at least 2,000 and not more than 10,000.

When a binder resin A and a binder resin B are used, viewed in terms of facile control of Mw/Mn:

the weight-average molecular weight (Mw) of the binder resin A is preferably at least 5,000 and not more than 30,000 and more preferably at least 5,000 and not more than 15,000;

the number-average molecular weight (Mn) of the binder resin A is preferably at least 2,000 and not more than 5,000 and more preferably at least 2,000 and not more than 4,000;

the weight-average molecular weight (Mw) of the binder resin B is preferably at least 10,000 and not more than 1,000,000 and more preferably at least 10,000 and not more than 500,000; and the number-average molecular weight (Mn) of the binder resin B is preferably at least 2,000 and not more than 5,000 and more preferably at least 2,000 and not more than 4,000.

The toner particle may contain a release agent.

A known release agent can be used without particular limitation as the release agent as long as it increases the releasability between the fixing sleeve and the toner image.

Examples here are aliphatic hydrocarbon waxes such as polyolefin copolymers, polyethylene waxes, microcrystalline waxes, paraffin waxes, and Fischer-Tropsch waxes.

These release agents include release agents whose molecular weight distribution has been sharpened using a press sweating method, solvent method, recrystallization method, vacuum distillation method, supercritical gas extraction method, or melt crystallization method.

Specific examples of the release agent are as follows:

VISKOL (registered trademark) 330-P, 550-P, 660-P, and TS-200 (Sanyo Chemical Industries, Ltd.); Hi-WAX 400P, 200P, 100P, 410P, 420P, 320P, 220P, 210P, and 110P (Mitsui Chemicals, Inc.); Sasol H1, H2, C80, C105, and C77 (Schumann Sasol); HNP-1, HNP-3, HNP-9, HNP-10, HNP-11, and HNP-12 (Nippon Seiro Co., Ltd.); UNILIN (registered trademark) 350, 425, 550, and 700 and UNICID (registered trademark) 350, 425, 550, and 700 (Toyo Adl Corporation); and Japan Wax, Beeswax, Rice Bran Wax, Candelilla Wax, and Carnauba Wax (available from Cerarica NODA Co., Ltd.).

With regard to the timing of addition of the release agent, it may be added during toner particle production or during production of the binder resin, and an appropriate selection from already known methods may be made. In addition, a single one of these release agents may be used or a combination may be used.

The release agent content is preferably at least 0.5 mass parts and not more than 20.0 mass parts per 100.0 mass parts of the binder resin.

Viewed from the perspective of the durability and low-temperature fixability of the toner, the melting point of the release agent is preferably at least 60° C. and not more than 120° C. and is more preferably at least 70° C. and not more than 110° C.

The toner of the present invention is a magnetic toner that contains a magnetic particle, but it may contain a known colorant. This known colorant can be exemplified by a black colorant such as carbon black and colorants provided with a black color by mixing the known yellow colorants, magenta colorants, and cyan colorants.

The toner particle may contain a charge control agent in order to stabilize its tribocharging characteristics.

Charge control agents that control the toner particle to a negative chargeability and charge control agents that control it to a positive chargeability are known as charge control agents, and a single one or two more of the various charge control agents may be used in correspondence to the type and application of the toner particle.

Charge control agents that control the toner particle to a negative chargeability are exemplified by the following:

organometal complexes (monoazo metal complexes, acetylacetone metal complexes); metal complexes or metal salts of aromatic hydroxycarboxylic acids or aromatic dicarboxylic acids; aromatic mono- and polycarboxylic acids and their metal salts and anhydrides; and phenol derivatives such as esters and bisphenols. Among the preceding, the metal complexes or metal salts of aromatic hydroxycarboxylic acids that provide a stable charging performance are preferred.

Charge control agents that control the toner particle to a positive chargeability are exemplified by the following:

nigrosine and nigrosine modifications from nigrosine and fatty acid metal salts; quaternary ammonium salts such as tributylbenzylammonium 1-hydroxy-4-naphthosulfonate and tetrabutylammonium tetrafluoroborate, and the onium salts, such as phosphonium salts, that are analogues of the preceding, as well as lake pigments of the preceding; triphenylmethane dyes and their lake pigments (the laking agent can be exemplified by phosphotungstic acid, phosphomolybdic acid, phosphotungstomolybdic acid, tannic acid, lauric acid, gallic acid, ferricyanic acid, and ferrocyanide compounds); and metal salts of higher fatty acids. Among the preceding, charge control agents such as nigrosine, nigrosine modifications, and quaternary ammonium salts are preferred.

A single one of these or combinations of two or more can be used in the present invention.

Specific examples are as follows: Spilon Black TRH, T-77, T-95, and TN-105 (Hodogaya Chemical Co., Ltd.); Bontron (registered trademark) S-34, S-44, E-84, and E-88 (Orient Chemical Industries Co., Ltd.); TP-302 and TP-415 (Hodogaya Chemical Co., Ltd.); Bontron (registered trademark) N-01, N-04, N-07, and P-51 (Orient Chemical Industries Co., Ltd.); and Copy Blue PR (Clariant).

The content of the charge control agent may be at least 0.1 mass parts and not more than 10 mass parts per 100 mass parts of the binder resin.

The method of producing the toner particle according to the present invention is not particularly limited, and, for example, a pulverization method, emulsion polymerization method, suspension polymerization method, or dissolution suspension method can be used.

This toner particle is preferably produced by passage through a step in which the binder resin and magnetic particle are melt kneaded.

By going through a melt kneading step, the low molecular weight component is then efficiently supported at the magnetic particle and a uniform dispersion in the toner is thereby facilitated. As a result, an excellent dispersibility is provided for the low molecular weight component and the low-temperature fixability and image quality after standing under harsh conditions are further improved.

The toner is preferably produced by a pulverization method in the present invention.

Production of the toner by a pulverization method, for example, may contain the following:

a step of mixing with a mixer, for example, a Henschel mixer or a ball mill, the binder resin and magnetic particle as well as the release agent and other additives;

a step of melt kneading the obtained mixture using a heated kneading apparatus, for example, a twin-screw kneading extruder, hot roll, kneader, or extruder; and a step of cooling and solidifying the melt-kneaded material followed by pulverization using a pulverizer and classification of the obtained pulverizate using a classifier to obtain a toner particle.

Moreover, in order to control the shape and surface properties of the toner particle, a step may also be included in which a surface treatment using a surface modification apparatus is carried out after pulverization and classification.

The toner particle as such may compose the toner, but as necessary the toner may also be provided by thoroughly admixing an external additive, infra, using a mixer such as a Mitsui Henschel Mixer (Mitsui Miike Chemical Engineering Machinery Co., Ltd.).

The mixer here can be exemplified by the following: the Henschel mixer (Mitsui Mining Co., Ltd.); Supermixer (Kawata Mfg. Co., Ltd.); Ribocone (Okawara Mfg. Co., Ltd.); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The aforementioned heated kneading apparatus can be exemplified by the following: KRC Kneader (Kurimoto, Ltd.); Buss Ko-Kneader (Buss Corp.); TEM extruder (Toshiba Machine Co., Ltd.).; TEX twin-screw kneader (The Japan Steel Works, Ltd.); PCM Kneader (Ikegai Ironworks, Ltd.); three-roll mills, mixing roll mills, and kneaders (Inoue Mfg., Inc.); Kneadex (Mitsui Mining Co., Ltd.); model MS pressure kneader and Kneader-Ruder (Moriyama Manufacturing Co., Ltd.); and Banbury mixer (Kobe Steel, Ltd.).

The aforementioned pulverizer can be exemplified by the following: Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

The aforementioned classifier can be exemplified by the following: Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

The aforementioned surface modification apparatus can be exemplified by the following: Faculty (Hosokawa Micron Corporation); Mechanofusion (Hosokawa Micron Corporation); Nobilta (Hosokawa Micron Corporation); Hybridizer (Nara Machinery Co., Ltd.); Inomizer (Hosokawa Micron Corporation); Theta Composer (Tokuju Co., Ltd.); and Mechanomill (Okada Seiko Co., Ltd.).

Screening devices that can be used to screen out the coarse particles can be exemplified by the following: Ultrasonic (Koei Sangyo Co., Ltd.); Rezona Sieve and Gyro-Sifter (Tokuju Co., Ltd.); Vibrasonic System (Dalton Co., Ltd.); Soniclean (Sintokogio, Ltd.); Turbo Screener (Turbo Kogyo Co., Ltd.); Microsifter (Makino Mfg. Co., Ltd.); and circular vibrating sieves.

A finely particulate (number-average primary particle diameter of about 5 to 30 nm) flowability improver that brings about an improvement in the flowability and chargeability of the toner is an example of the aforementioned external additive.

This flowability improver can be exemplified by fluororesin powders such as vinylidene fluoride fine powder and polytetrafluoroethylene fine powder; silica fine particles such as wet-method silica and dry-method silica, titanium oxide fine particles, and alumina fine particles and treated fine particles provided by executing a surface treatment on the preceding using a silane compound, titanium coupling agent, or silicone oil; oxides such as zinc oxide and tin oxide; composite oxides such as strontium titanate, barium titanate, calcium titanate, strontium zirconate, and calcium zirconate; and carbonate salt compounds such as calcium carbonate and magnesium carbonate.

Among the preceding, preferred flowability improvers are silica fine particles produced by the vapor-phase oxidation of a silicon halide compound, known as dry silica or fumed silica. For example, this uses a pyrolytic oxidation reaction of silicon tetrachloride gas in an oxyhydrogen flame and proceeds according to the following basic reaction equation.

$$SiCl_4+2H_2+O_2 \rightarrow SiO_2+4HCl$$

A composite fine particle of silica and another metal oxide can also be obtained in this production process by using the silicon halide compound in combination with another metal halide compound, e.g., aluminum chloride or titanium chloride, and these are also encompassed by the silica fine particles.

Examples of commercially available silica fine particles produced by the vapor-phase oxidation of a silicon halide compound are as follows: AEROSIL (Nippon Aerosil Co., Ltd.) 130, 200, 300, 380, TT600, MQX170, MOX80, and COK84; Cab-O-Sil (Cabot Corporation) M-5, MS-7, MS-75, HS-5, and EH-5; Wacker HDK N 20 (Wacker-Chemie GmbH) V15, N20E, T30, and T40; D-C Fine Silica (Dow Corning Corp.); and Fransol (Fransil Co.).

The flowability improver is more preferably a treated silica fine particle provided by carrying out a hydrophobic treatment on a silica fine particle produced by the vapor-phase oxidation of a silicon halide compound.

The specific surface area of the treated silica fine particle as measured by nitrogen adsorption by the BET method is preferably at least 30 $m^2/g$ and not more than 300 $m^2/g$.

The amount of external additive addition, per 100 mass parts of the toner particle, is preferably at least 0.010 mass parts and not more than 8.0 mass parts and more preferably at least 0.10 mass parts and not more than 4.0 mass parts.

The methods for measuring the various properties pertaining to the present invention are described below.

<Method for Isolating the Magnetic Particles From the Toner>

(1) 50 mg of the toner and 20 mL of tetrahydrofuran (THF) are weighed into a 50-mL vial followed by standing at quiescence for 5 hours. Thorough shaking is then performed and dissolution in the THF is carried out until aggregates of the sample are not present. The base dissolution temperature is 25° C., and dissolution is carried out in the range from 25° C. to 50° C. depending on sample solubility.

(2) A neodymium magnetic (AS ONE Corporation, Model NE019, diameter×thickness=Ø 22 mm×10 mm, surface magnetic flux density=450 mT) is then applied from the outside of the vial and the supernatant THF solution is separated while holding the magnetic particles at the bottom of the vial.

(3) Another 20 mL of THF is then added to the vial; thorough shaking is again carried out in order to wash the magnetic particles; the neodymium magnet is subsequently applied from the outside of the vial; and the supernatant THF solution is separated while holding the magnetic particles at the bottom of the vial.

(4) The magnetic particles are thoroughly washed by carrying out the process in (3) at least 100 times.

(5) Drying the magnetic particles after washing then yields the magnetic particles isolated from the toner.

<Method for Measuring the Number-Average Primary Particle Diameter (D1) of the Magnetic Particles and Method for Identifying the Shape of the Magnetic Particles>

The number-average primary particle diameter (D1) of the magnetic particles and the shape of the magnetic particles are measured or observed using a scanning electron microscope (JSM-6830F, JEOL Ltd.).

The magnetic particles are observed at 30,000×; the diameter (maximum diameter) is measured on 100 randomly selected primary particles of the magnetic particles; and the average value of the results of measurement of the 100 diameters is used as the number-average primary particle diameter (D1) of the magnetic particles. In addition, the shape is evaluated by observing the shape of these 100 magnetic particles.

The magnetic particles used as a starting material may be used for the magnetic particles here, but the magnetic particles isolated in accordance with the aforementioned method for isolating the magnetic particles from the toner may also be used for the magnetic particles here.

<Presence/Absence of Protruded Portions on the Magnetic Particles and Method for Measuring the Height of the Protruded Portions>

The magnetic particles are observed using a transmission electron microscope (JEM-2100, JEOL Ltd.), and the height h (with the proviso that h≥1 nm) from the coating layer base to the top of the protruded portion, as shown in FIG. 3, is measured on the plane portion of the octahedral shape of the magnetic particles. The height of 15 randomly selected protruded portions is measured and the average value is determined and used as the height of the protruded portion. The presence/absence of the protruded portion is determined by whether a portion forming the height h (with the proviso that h≥1 nm) from the coating layer base to the top of the protruded portion is present.

The magnetic particles used as a starting material may be used for the magnetic particles here, but the magnetic particles isolated in accordance with the aforementioned method for isolating the magnetic particles from the toner may also be used for the magnetic particles here.

<Method for Analyzing the Elements in the Coating Layer of the Magnetic Particles>

The proportions for the elements contained in the coating layer of the magnetic particle is determined by the following method.

25 g of the magnetic particles is suspended in 5 L of 5 mass % dilute sulfuric acid at 50° C. to obtain a measurement solution, and 25 mL of the measurement solution is sampled at each prescribed time (5, 15, 25, 35, 45, 60, 75, 90, 105, and 120 minutes). The obtained sample solution is filtered across a membrane filter, and the silicon, aluminum, and iron concentrations in the obtained solution are measured by quantitation using a high-frequency inductively coupled plasma (ICP) atomic emission spectrometer (instrument name: ICP-S2000, supplier: Shimadzu Corporation).

The proportion (mass %) of each element is calculated as follows: each total amount (g) for the silicon, aluminum, and iron up to the time points at which the detected amounts of silicon, aluminum, and iron become constant is divided by 25 g followed by multiplication by 100.

The magnetic particles used as a starting material may be used for the magnetic particles here, but the magnetic particles isolated in accordance with the aforementioned method for isolating the magnetic particles from the toner may also be used for the magnetic particles here.

<Method for Measuring the Total Pore Volume of the Magnetic Particles>

Using a Tristar 3000 (Shimadzu Corporation) pore distribution analyzer, the total pore volume of the magnetic particles is measured by a gas adsorption method in which the adsorption of nitrogen gas to the sample surface is carried out.

Prior to the measurement, 2.0 to 3.0 g of the sample is introduced into a test tube and this is placed under a vacuum for 24 hours at 100° C.

After completion of the vacuum draw, the sample mass is exactly weighed to obtain the measurement sample. The density of the sample at this point was 4.94 g/cm$^3$.

Using the obtained measurement sample and the aforementioned pore distribution analyzer, the total pore volume is determined by the BJH desorption method as the cumulative value for the pore volume in the pore diameter range of at least 1.7 nm and not more than 300.0 nm. The total pore volume closest to the measurement data information is used as the index for evaluation of the pore distribution.

The magnetic particles used as a starting material may be used for the magnetic particles here, but the magnetic particles isolated in accordance with the aforementioned method for isolating the magnetic particles from the toner may also be used for the magnetic particles here.

<Method for Measuring the Glass Transition Temperature (Tg) of the Binder Resin>

The glass transition temperature (Tg) of the binder resin is measured based on ASTM D 3418-82 using a "Q2000" differential scanning calorimeter (TA Instruments).

Temperature correction in the instrument detection section is performed using the melting points of indium and zinc, and the amount of heat is corrected using the heat of fusion of indium.

Specifically, approximately 2.0 mg of the sample is exactly weighed out and this is introduced into an aluminum pan, and the measurement is run at; a ramp rate of 10°

C./min in the measurement temperature range between −10° C. and 200° C. using an empty aluminum pan as reference.

For the measurement, the sample is heated at a ramp rate of 10° C./min from −10° C. to 200° C., is then cooled at a ramp down rate of 10° C./min from 200° C. to −10° C., and is subsequently reheated.

The change in the specific heat in the temperature range from 30° C. to 100° C. is obtained in this second heating process. When this is done, the glass transition temperature (Tg) of the binder resin is the temperature (° C.) at the intersection between the curve segment for the stepwise change at the glass transition and the straight line that is equidistant, in the direction of the vertical axis, from the straight lines formed by extending the baselines for prior to and subsequent to the appearance of the change in the specific heat.

<Method for Measuring the Weight-Average Molecular Weight (Mw) and Number-Average Molecular Weight (Mn) of the Tetrahydrofuran (THF)-Soluble Matter and the Proportion of a Component With a Molecular Weight Equal to or Less Than 1,000>

(1) Preparation of the Sample Solution

The sample (toner or resin) is introduced into THF and this is held for 5 hours, followed by thorough shaking and dissolution in THF until aggregates of the sample are not present. The base dissolution temperature is 25° C., and dissolution is carried out in the range from 25° C. to 50° C. depending on sample solubility. This was followed by storage at quiescence at 25° C. for at least 12 hours. The holding time in THF is brought to 24 hours at this time.

After this, a sample for gel permeation chromatography (GPC) is obtained by passage across a sample treatment filter (for example, a Pretreatment Disk H-25-2 with a pore size of at least 0.2 nm and not more than 0.5 μm (Tosoh Corporation) can be used).

The sample concentration is adjusted to provide a resin component of at least 0.5 mg/mL and not more than 5.0 mg/mL.

The column is stabilized in a 40° C. heated chamber; THF is introduced as solvent into the column at this temperature at a flow rate of 1 mL/minute; and approximately 100 μL of the THF sample solution is introduced and the measurement is carried out.

The molecular weight distribution exhibited by the sample is determined in measurement of the molecular weight of the sample from the relationship between the logarithmic value and the count value in a calibration curve constructed using multiple monodisperse polystyrene reference samples.

The standard polystyrene samples used to construct the calibration curve are from Tosoh Corporation and have molecular weights of $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$, and $4.48\times10^6$. A refractive index (RI) detector is used for the detector.

In order to accurately measure the molecular weight range from $1\times10^3$ to $2\times10^6$, a combination of multiple commercial polystyrene gel columns as indicated below is used for the column. The GPC measurement conditions in the present invention are as follows.

[GPC Measurement Conditions]

instrument: LC-GPC 150C (Waters Corporation)

column: 7-column train of Showdex KF801, 802, 803, 804, 805, 806 and 807 (Showa Denko K.K.)

column temperature: 40° C.

mobile phase: tetrahydrofuran (THF)

Based on a chart of the molecular weight distribution obtained by the above GPC measurement (the horizontal axis: retention time, the vertical axis: voltage value detected by RI), a proportion (area %) of a peak area of the molecular weight being equal to or less than 1,000 with regard to a total peak area of the molecular weight distribution was calculated and considered to be a proportion (mass %) of a component with a molecular weight equal to or less than 1,000 in tetrahydrofuran (THF)-soluble matter.

<Method for Measuring the Softening Point of the Binder Resin>

The softening point of the binder resin is measured according to the manual provided with the instrument, using the "Flowtester CFT-500D Flow Property Evaluation Instrument" (Shimadzu Corporation), a constant-load extrusion-type capillary rheometer.

With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature is obtained from this.

The "melting temperature by the ½ method", as described in the manual provided with the "Flowtester CFT-500D Flow Property Evaluation Instrument", is used as the softening point in the present invention. The melting temperature by the ½ method is determined as follows.

First, ½ of the difference between Smax, which is the piston stroke at the completion of outflow, and Smin, which is the piston stroke at the start of outflow, is determined (this value is designated as X, where X=(Smax−Smin)/2).

The temperature of the flow curve when the piston stroke in the flow curve reaches the sum of X and Smin is the melting temperature by the ½ method.

The measurement sample used is prepared by subjecting 1.0 g of the sample to compression molding for approximately 60 seconds at approximately 10 MPa in a 25° C. environment using a tablet compression molder (NT-100H, NPa System Co., Ltd.) to provide a cylindrical shape with a diameter of approximately 8 mm.

The measurement conditions with the CFT-500D are as follows.

test mode: rising temperature method ramp rate: 4° C./min start temperature: 40° C.

saturated temperature: 200° C.

measurement interval: 1.0° C.

piston cross section area: 1.000 $cm^2$ test load (piston load): 10.0 kgf (0.9807 MPa)

preheating time: 300 seconds diameter of die orifice: 1.0 mm die length: 1.0 mm

<Method for Measuring the Resin Component Insoluble in Tetrahydrofuran (THF) (THF-Insoluble Matter)>

Approximately 1.5 g of the toner (or resin) is exactly weighed (W1, g) and is introduced into a thimble (product name: No. 86R, size 28 mm×100 mm, Advantec Toyo Kaisha, Ltd.) that has been exactly weighed in advance and this is set into a Soxhlet extractor.

Extraction is carried out for 20 hours using 200 mL of tetrahydrofuran (THF) for the solvent, and this extraction is carried out at a reflux rate that provides one solvent extraction cycle in approximately 5 minutes.

After the completion of extraction, the thimble is removed and is air dried and then vacuum dried for 8 hours at 40° C. The mass of the thimble containing the extraction residue is weighed, and the mass of the extraction residue (W2, g) is calculated by subtracting the mass of the thimble.

The content (W3, g) of the component other than the resin component is determined using the following procedure.

Approximately 2 g of the toner is exactly weighed (Wa, g) into a 30-mL porcelain crucible that has been weighed in advance.

The porcelain crucible is placed in an electric furnace and is heated for approximately 3 hours at approximately 900° C. and is allowed to cool in the electric furnace and is allowed to cool for at least 1 hour in a desiccator at normal temperature. The mass of the crucible containing the residual incineration ash is weighed and the residual incineration ash (Wb, g) is calculated by subtracting the mass of the crucible.

The mass (W3, g) of the residual incineration ash in the sample (W1, g) is calculated using the following formula (A).

$$W3=1\times(Wb/Wa) \quad (A)$$

In this case the THF-insoluble matter is determined using the following formula (B).

$$THF\text{-insoluble matter (mass \%)}=[(W2-W3)]/(W1-W3)]\times 100 \quad (B)$$

<Method for Measuring the Weight-Average Particle Diameter (D4) of the Toner>

The weight-average particle diameter (D4) of the toner is determined as follows. The measurement instrument used is a "Coulter Counter Multisizer 3" (registered trademark, Beckman Coulter, Inc.), a precision particle size distribution measurement instrument operating on the pore electrical resistance method and equipped with a 100 μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement button". In addition, the current is set to 1, 600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the approximately three-fold (mass) dilution with deionized water of "Contaminon N" (product name; a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) An "Ultrasonic Dispersion System Tetora 150" (product name; Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of deionized water is introduced into the water tank of this ultrasound disperser and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

EXAMPLES

The present invention is described in additional detail in the following using examples and comparative examples; however, the present invention is in no way limited to or by these. The number of parts and % used in the examples and comparative examples are on a mass basis in all instances unless specifically indicated otherwise.

<Hybrid Resin 1 (H1) Production Example>

The monomers constituting the polyester segment were introduced in the blend amounts given in Table 1 into a reaction vessel fitted with a nitrogen introduction line, a water separator, a stirrer, and a thermocouple, followed by the addition as catalyst of 1.5 mass parts of dibutyltin per 100 mass parts of the total amount of monomer constituting the polyester segment. The temperature in the vessel was raised to 160° C. while stirring under a nitrogen atmosphere.

A mixture of 2.0 mol parts of benzoyl peroxide as polymerization initiator and the vinyl monomer (including dual reactive compounds) in the blend amounts (mol parts) given in Table 1 was prepared and was added dropwise to the reaction vessel over 4 hours from a dropping funnel.

At this point, the amount of dropwise addition was adjusted to provide the mass ratio between the polyester segment and vinyl polymer segment given in Table 1.

After the completion of the dropwise addition, a reaction was carried out for 4 hours at 160° C. followed by carrying out a condensation polymerization reaction by reducing the pressure in the reaction system while heating to 230° C.

Here, the condensation polymerization time after the start of the pressure reduction was established so the softening point of the obtained hybrid resin 1 assumed the value in Table 1.

After the completion of the reaction of hybrid resin 1, it was removed from the reaction vessel, cooled, and pulverized to obtain the hybrid resin 1 (H1). The properties of hybrid resin 1 are given in Table 1.

In order to determine the condensation polymerization time that would give the desired softening point, in preliminary investigations the hybrid resin was removed from the reaction vessel at several different condensation polymerization times after the start of the pressure reduction, and was cooled and pulverized and the softening point was then measured. The determination of the condensation polymerization time that provided the softening point given in Table 1 was made based on the correspondence relationship, obtained in this preliminary investigation, between the softening point and the condensation polymerization time for the formulation of hybrid resin 1.

TABLE 1

| | | | | hybrid resin | | |
|---|---|---|---|---|---|---|
| | | | | H1 | H2 | H3 |
| vinyl polymer segment | vinyl monomer (mol parts) | acrylic acid | | 10 | — | 10 |
| | | fumaric acid | | — | 5 | — |
| | | styrene | | 75 | 79 | 78 |
| | | n-butyl acrylate | | 15 | 16 | — |
| | | 2-ethylhexyl acrylate | | — | — | 12 |
| polyester segment | alcohol monomer (mol parts) | BPA-PO | | 30 | 45 | 37 |
| | | BPA-EO | | 30 | 15 | 23 |
| | carboxylic acid monomer (mol parts) | TPA | | 25 | 20 | 15 |
| | | IPA | | — | 5 | 7 |
| | | TMA | | 8 | 5 | 15 |
| | | FA | | — | — | 3 |
| | | AA | | 15 | 18 | 6 |
| | | DSA | | — | — | 2 |
| polyester segment:vinyl polymer segment (mass ratio) | | | | 80:20 | 90:10 | 60:40 |
| properties of the binder resin | Tg | | (° C.) | 60.2 | 59.0 | 60.0 |
| | softening point | | (° C.) | 127.0 | 128.0 | 140.0 |
| | Mw/Mn | | (—) | 33.0 | 46.0 | 59.0 |
| | Mw | | (—) | 131000 | 169000 | 260000 |
| | Mn | | (—) | 3970 | 3670 | 4410 |
| | THF-insoluble matter | | (mass %) | 16.0 | 26.0 | 30.0 |

The abbreviations used in the table are as follows.

BPA-PO: bisphenol A-propylene oxide 2 mol adduct

BPA-EO: bisphenol A-ethylene oxide 2 mol adduct

TPA: terephthalic acid

IPA: isophthalic acid

TMA: trimellitic acid

FA: fumaric acid

AA: adipic acid

DSA: dodecenylsuccinic acid

<Hybrid Resins 2 (H2) and 3 (H3) Production Example>

Hybrid resins 2 and 3 were obtained as in the Hybrid Resin 1 Production Example, with the exception of changing the following in the Hybrid Resin 1 Production Example: the monomer for the polyester segment, the monomer for the vinyl polymer segment, and their blend amounts as shown in Table 1, and the condensation polymerization time.

Their properties are shown in Table 1. A preliminary investigation into the condensation polymerization time was carried out as in the Hybrid Resin 1 Production Example, and for each formulation the condensation polymerization time that gave the softening point given in Table 1 was determined based on the correspondence relationship between the softening point and condensation polymerization time.

<Polyester Resin 1 Production Example>

The starting monomers were introduced in the blend amounts (mol parts) given in Table 2 into a reaction vessel fitted with a nitrogen introduction line, a water separator, a stirrer, and a thermocouple, followed by the addition as catalyst of 1.0 mass part of dibutyltin per 100 mass parts of the total amount of the starting monomer. The temperature in the flask was raised to 120° C. while stirring under a nitrogen atmosphere.

A condensation polymerization was then run by distilling out the water while stirring and heating from 120° C. to 200° C. at a ramp rate of 10° C./hour. After 200° C. had been reached, the pressure within the reaction vessel was reduced to 5 kPa or less and a condensation polymerization reaction was run for 3 hours under conditions of 200° C. and 5 kPa or less. This was followed by cooling and pulverization to produce polyester resin 1 (P1). The properties of the obtained P1 are given in Table 2.

TABLE 2

| | | | P1 | P2 |
|---|---|---|---|---|
| polyester resin | alcohol monomer (mol parts) | BPA-PO | 44 | 45 |
| | | BPA-EO | 38 | 7 |
| | | EG | 18 | — |
| | carboxylic acid monomer (mol parts) | TPA | 89 | 25 |
| | | TMA | — | 4 |
| | | AA | — | 20 |
| properties of the resin | Tg | (° C.) | 58.5 | 58.5 |
| | softening point | (° C.) | 90.0 | 130.0 |
| | Mw/Mn | (—) | 2.2 | 14.9 |
| | Mw | (—) | 8350 | 51500 |
| | Mn | (—) | 3800 | 3450 |
| | THF-insoluble matter | (%) | 0 | 5.3 |

The abbreviations used in the table are as follows.

BPA-PO: bisphenol A-propylene oxide 2 mol adduct

BPA-EO: bisphenol A-ethylene oxide 2 mol adduct

EG: ethylene glycol

TPA: terephthalic acid

TMA: trimellitic acid

AA: adipic acid

<Polyester Resin 2 Production Example>

Polyester resin 2 (P2) was produced as in the Polyester Resin 1 Production Example, with the exception of changing the monomer and blend amount as shown in Table 2 and using 5 hours for the condensation polymerization time under conditions of at least 200° C. and 5 kPa or less. The properties of the obtained P2 are given in Table 2.

<Styrene-Acrylic Resin 1 Production Example> styrene 78.0 mass parts (81.4 mol parts)

n-butyl acrylate 22.0 mass parts (18.6 mol parts)

di-t-butyl peroxide 5.0 mass parts

After heating 200 mass parts of xylene to 200° C., the preceding components were added dropwise to the xylene over 4 hours and the polymerization was completed by holding for an additional 1 hour under a xylene reflux.

The properties of the obtained styrene-acrylic resin 1 (S1) are given in Table 3.

<Styrene-Acrylic Resins 2 to 5 Production Example>

Styrene-acrylic resins 2 to 5 (S2 to S5) were obtained as in the Styrene-Acrylic Resin 1 Production Example, with the exception of changing the amount of addition of the di-t-butyl peroxide in the Styrene-Acrylic Resin 1 Production Example as shown below. Their property values are given in Table 3.

styrene-acrylic resin 2: di-t-butyl peroxide 8.0 mass parts styrene-acrylic resin 3: di-t-butyl peroxide 4.0 mass parts styrene-acrylic resin 4: di-t-butyl peroxide 10.0 mass parts styrene-acrylic resin 5: di-t-butyl peroxide 3.0 mass parts <Styrene-Acrylic Resin 6 Production Example>

180 mass parts of degassed water and 20 mass parts of a 2 mass % aqueous solution of polyvinyl alcohol were introduced into a four-neck flask.

Then, a mixture of styrene 75.0 mass parts (78.7 mol parts)

n-butyl acrylate 25.0 mass parts (21.3 mol parts)

divinylbenzene 0.50 mass parts (0.42 mol parts)

2,2-bis(4,4-di-tert-butylperoxycyclohexyl)propane (10-hour half-life temperature=92° C.) 0.10 mass parts was added and stirring was performed to provide a suspension.

After the interior of the flask had been thoroughly substituted with nitrogen, the temperature was raised to 85° C. and polymerization was carried out. After holding for 24 hours, a supplemental addition of 0.1 mass parts of benzoyl peroxide (10-hour half-life temperature=72° C.) was made and holding was performed for an additional 12 hours to complete the polymerization of styrene-acrylic resin 6 (S6).

After this, the organic solvent was removed with thorough mixing under reflux to obtain the styrene-acrylic resin S6 shown in Table 3.

<Styrene-Acrylic Resins 7 to 10 Production Example>

Styrene-acrylic resins according to styrene-acrylic resins 7 to 10 (S7 to S10) were obtained as for styrene-acrylic resin 6, with the exception of changing the amount of divinylbenzene addition in the Styrene-Acrylic Resin 6 Production Example as indicated below. The property values for each are given in Table 3.

styrene-acrylic resin 7: divinylbenzene 0.40 mass parts (0.33 mol parts)

styrene-acrylic resin 8: divinylbenzene 0.70 mass parts (0.58 mol parts)

styrene-acrylic resin 9: divinylbenzene 0.30 mass parts (0.25 mol parts)

styrene-acrylic resin 10: divinylbenzene 0.90 mass parts (0.75 mol parts)

<Styrene-Acrylic Resin 11 Production Example>

(Production of high molecular weight vinyl resin Sa)

styrene 80.0 mass parts n-butyl acrylate 18.0 mass parts methacrylic acid 2.0 mass parts 2, 2-bis(4,4-di-t-butylperoxycyclohexyl)propane 2.4 mass parts While stirring 200 mass parts of xylene in a four-neck flask, the interior of the flask was thoroughly substituted with nitrogen, the temperature was raised to 120° C., and the components listed above were then added dropwise over 4 hours. Holding for an additional 10 hours was performed under a xylene reflux to complete the polymerization, and the solvent was then distilled off under reduced pressure. The high molecular weight vinyl resin Sa was obtained in this manner.

(Production of Low Molecular Weight Vinyl Resin Sb)

styrene 75.0 mass parts n-butyl acrylate 24.5 mass parts methacrylic acid 0.5 mass parts di-t-butyl peroxide 4.0 mass parts 200 mass parts of xylene was heated to 200° C. and the preceding components were added dropwise to the xylene over 4 hours. Holding for an additional 1 hour under a xylene reflux provided the low molecular weight vinyl resin Sb.

(Production of Glycidyl-Containing Vinyl Resin Sc)

styrene 76.4 mass parts n-butyl acrylate 18.0 mass parts glycidyl methacrylate 5.6 mass parts di-t-butyl peroxide 5.0 mass parts While stirring 200 mass parts of xylene in a four-neck flask, the interior of the flask was thoroughly substituted with nitrogen and the temperature was raised to 120° C. and the components listed above were then added dropwise over 4 hours. The polymerization was completed after an additional xylene reflux, and the solvent was distilled out under reduced pressure to obtain a glycidyl group-containing vinyl resin Sc.

A xylene solution of the high molecular weight vinyl resin Sa and a xylene solution of the low molecular weight vinyl resin Sb were mixed in a four-neck flask so as to provide 30 mass parts of the high molecular weight vinyl resin Sa and 70 mass parts of the low molecular weight vinyl resin Sb. After this, the temperature was raised and stirring was carried out under reflux and the organic solvent was distilled out, and the obtained resin was cooled and solidified and then pulverized.

98 mass parts of this Sa+Sb mixture was mixed using a Henschel mixer with 2 mass parts of the glycidyl group-containing vinyl resin Sc. A crosslinking reaction was then carried out at 180° C. using a twin-screw extruder, followed by cooling and then pulverization to obtain a styrene-acrylic resin 11 (S11). The properties of S11 are given in Table 3.

<Styrene-Acrylic Resin 12 Production Example>

A styrene-acrylic resin 12 (S12) was obtained as in the Styrene-Acrylic Resin 11 Production Example, with the exception of mixing 90 mass parts of the Sa+Sb mixture with 10 mass parts of the glycidyl group-containing vinyl resin Sc in the Styrene-Acrylic Resin 11 Production Example. The properties of S12 are given in Table 3.

<Styrene-Acrylic Resin 13 Production Example>

A styrene-acrylic resin 13 (S13) was obtained as in the Styrene-Acrylic Resin 11 Production Example, with the exception that the glycidyl group-containing vinyl resin Sc was not added in the Styrene-Acrylic Resin 11 Production Example. The properties of S13 are given in Table 3.

<Styrene-Acrylic Resin 14 Production Example>

A styrene-acrylic resin 14 (S14) was obtained as in the Styrene-Acrylic Resin 11 Production Example, with the exception of carrying out the mixing in the Styrene-Acrylic Resin 11 Production Example so as to provide 20 mass parts of the high molecular weight vinyl resin Sa and 80 mass parts of the low molecular weight vinyl resin Sb. The properties of S14 are given in Table 3.

<Styrene-Acrylic Resin 15 Production Example>

A styrene-acrylic resin 15 (S15) was obtained as in the Styrene-Acrylic Resin 11 Production Example, with the exception of mixing 85 mass parts of the Sa+Sb mixture with 15 mass parts of the glycidyl group-containing vinyl resin Sc in the Styrene-Acrylic Resin 11 Production Example. The properties of S15 are given in Table 3.

TABLE 3

| | resin | S1 | S2 | S3 | S4 | S5 | S6 | S7 | S8 |
|---|---|---|---|---|---|---|---|---|---|
| resin properties | Tg (° C.) | 60.2 | 60.2 | 60.2 | 60.2 | 60.2 | 60.0 | 60.0 | 60.0 |
| | softening point (° C.) | 92.2 | 80.0 | 100.0 | 75.0 | 105.0 | 138.0 | 120.0 | 160.0 |
| | Mw/Mn | 3.0 | 3.0 | 4.0 | 2.6 | 6.9 | 23.0 | 19.0 | 39.6 |
| | Mw | 9100 | 8400 | 13200 | 6750 | 22070 | 94500 | 51300 | 190000 |
| | Mn | 3030 | 2800 | 3300 | 2600 | 3200 | 4100 | 2700 | 4800 |
| | THF-insoluble matter (mass %) | 2.0 | 1.2 | 3.0 | 1.2 | 3.0 | 19.0 | 15.0 | 30.0 |

| | resin | S9 | S10 | S11 | S12 | S13 | S14 | S15 |
|---|---|---|---|---|---|---|---|---|
| resin properties | Tg (° C.) | 60.0 | 60.0 | 60.0 | 60.0 | 58.0 | 60.0 | 60.0 |
| | softening point (° C.) | 115.0 | 165.0 | 130.0 | 151.0 | 116.3 | 125.0 | 147.0 |
| | Mw/Mn | 13.0 | 44.0 | 12.7 | 77.0 | 7.0 | 12.1 | 61.0 |
| | Mw | 4000 | 227000 | 50800 | 194000 | 45000 | 45800 | 166000 |
| | Mn | 3380 | 5160 | 4000 | 2520 | 6400 | 3800 | 2720 |
| | THF-insoluble matter (mass %) | 14.0 | 35.0 | 3.7 | 27.0 | 0.0 | 1.8 | 33.0 |

<Magnetic Particle 1 Production Example>

(1) Core Particle Production

92 L of an aqueous ferrous sulfate solution having an $Fe^{2+}$ concentration of 1.79 mol/L and 88 L of an aqueous 3.74 mol/L sodium hydroxide solution were combined and mixed by stirring. The pH of this solution was 6.5.

While maintaining this solution at a temperature of 89° C. and a pH of 9 to 12, air was blown in at 20 L/min to cause an oxidation reaction and produce the core particles. The air injection was halted at the point at which the ferrous hydroxide had been completely consumed and the oxidation reaction was thus completed. The obtained core particles composed of magnetite had an octahedral shape or an octahedron-like shape.

(2) Formation of the Coating Layer 2.00 L of a 0.7 mol/L aqueous sodium silicate solution was mixed with 2.00 L of a 0.90 mol/L aqueous ferrous sulfate solution; 1.00 L of water was then added to give a 5.00 L aqueous solution; and this was added, while maintaining a pH of 7 to 9, to the aforementioned post-reaction slurry that contained 13,500 g of core particles. After this, air was injected at 10 L/min until $Fe^{2+}$ was no longer present in the slurry.

Then, 2.00 L of a 1.50 mol/L aqueous aluminum sulfate solution was mixed with 2.00 L of a 0.90 mol/L aqueous ferrous sulfate solution; 1.00 L of water was then added to give a 5.00 L aqueous solution; and this was added, while maintaining a pH of 7 to 9, to the aforementioned post-reaction slurry that contained the core particles. After this, air was injected at 10 L/min until $Fe^{2+}$ was no longer present in the slurry.

The temperature of the slurry was held at 89° C. After mixing and stirring for 30 minutes, the slurry was filtered followed by washing and drying to obtain the magnetic particle 1.

Magnetic particle 1 had an octahedral shape; had protruded portions on the flat parts of the octahedron; and had a protruded, portion height of 10.3 nm. Magnetic particle 1 had a number-average primary particle diameter (D1) of 120 nm and a total pore volume of 0.069 $cm^3/g$.

The results of the observation of magnetic particle 1 are given in FIGS. 1A and 1B.

<Magnetic Particles 2 to 11 Production Example>

Magnetic particles 2 to 11 were obtained as in the Magnetic Particle 1 Production Example, with the exception of changing the core particle production conditions and the coating layer formation conditions as appropriate so as to provide the ultimately obtained magnetic particles with the properties in Table 5.

The type of metal salt used for magnetic particles 2 to 11 and its amount of addition are given in Table 4, while the properties of magnetic particles 2 to 11 are given in Table 5. In the case of magnetic particle 11, the magnetic particle was adjusted to a spherical shape by using a pH of 6.5 to 8.5 during the wet oxidation reaction for the core particle production conditions.

Figure 2A:
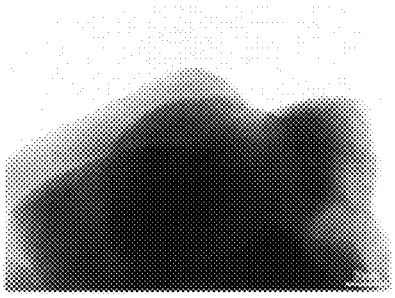
FIGS. 2A to 2C are TEM photographs of magnetic particles used in the comparative examples (photographs in lieu of drawings)
Figure 2B:
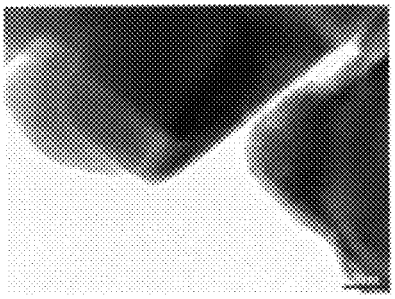
Figure 2C:
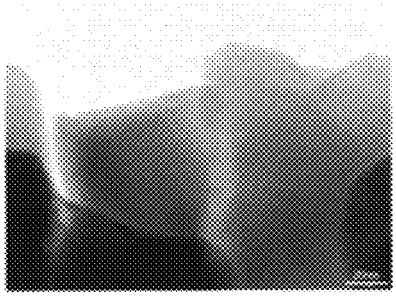

The results of the observation of magnetic particle 8 are given in FIGS. 2A to 2C.

TABLE 4

| magnetic particle | reaction conditions for coating layer formation: type of metal salt added and its amount of addition (a) sodium silicate: concentration (mol/L) | (a) sodium silicate: solution amount (L) | (a) ferrous sulfate: concentration (mol/L) | (a) ferrous sulfate: solution amount (L) | (b) aluminum sulfate: concentration (mol/L) | (b) aluminum sulfate: solution amount (L) | (b) ferrous sulfate: concentration (mol/L) | (b) ferrous sulfate: solution amount (L) | pH in coating layer formation | temperature (° C.) |
|---|---|---|---|---|---|---|---|---|---|---|
| magnetic particle 1 | 0.70 | 2.00 | 0.90 | 2.00 | 1.50 | 2.00 | 0.90 | 2.00 | 7-9 | 89 |
| magnetic particle 2 | 0.70 | 1.00 | 0.90 | 2.00 | 1.50 | 1.13 | 0.90 | 2.00 | 7-9 | 89 |
| magnetic particle 3 | 0.70 | 2.00 | 0.90 | 2.00 | 1.50 | 1.13 | 0.90 | 2.00 | 7-9 | 89 |
| magnetic particle 4 | 0.70 | 2.00 | 0.90 | 2.00 | 1.50 | 2.00 | 0.90 | 2.00 | 7-9 | 89 |
| magnetic particle 5 | 0.70 | 2.00 | 0.90 | 1.00 | 1.50 | 2.00 | 0.90 | 1.00 | 7-9 | 89 |
| magnetic particle 6 | — | — | — | — | — | — | — | — | 7-9 | 89 |
| magnetic particle 7 | 0.70 | 1.00 | 0.90 | 2.00 | — | — | — | — | 7-9 | 89 |
| magnetic particle 8 | — | — | — | — | 1.50 | 1.00 | 0.90 | 2.00 | 7-9 | 89 |
| magnetic particle 9 | 0.70 | 0.71 | — | — | 1.50 | 0.67 | — | — | 7-9 | 89 |
| magnetic particle 10 | 0.70 | 2.00 | 0.90 | 5.33 | 1.50 | 2.00 | 0.90 | 5.33 | 7-9 | 89 |
| magnetic particle 11 | 0.70 | 0.70 | 0.90 | 2.00 | 1.50 | 0.57 | 0.90 | 2.00 | 7-9 | 89 |

TABLE 5

| magnetic particle No. | number-average primary particle diameter nm | total pore volume $cm^3/g$ | shape — | presence/absence of protruded portion — | presence/absence of coating layer — | proportion in coating layer (mass %): silicon (Si) | aluminum (Al) | iron (Fe) | molar ratio in coating layer: Si/Fe | Al/Fe | height of protruded portion nm |
|---|---|---|---|---|---|---|---|---|---|---|---|
| 1 | 120 | 0.069 | octahedral | present | present | 12.2 | 25.2 | 62.6 | 0.40 | 0.80 | 10.3 |
| 2 | 110 | 0.075 | octahedral | present | present | 7.4 | 17.1 | 75.5 | 0.20 | 0.50 | 9.2 |
| 3 | 100 | 0.090 | octahedral | present | present | 13.7 | 16.0 | 70.3 | 0.40 | 0.50 | 8.2 |
| 4 | 150 | 0.060 | octahedral | present | present | 12.2 | 25.2 | 62.6 | 0.40 | 0.80 | 11.1 |
| 5 | 110 | 0.063 | octahedral | present | present | 17.8 | 36.7 | 45.5 | 0.80 | 1.70 | 7.8 |
| 6 | 120 | 0.045 | octahedral | absent | absent | 0.0 | 0.0 | 0.0 | — | — | — |
| 7 | 130 | 0.041 | octahedral | absent | present | 16.4 | 0.0 | 83.6 | 0.80 | 0.00 | — |
| 8 | 110 | 0.052 | octahedral | absent | present | 0.0 | 28.0 | 71.3 | 0.00 | 1.70 | — |
| 9 | 110 | 0.052 | octahedral | absent | present | 34.0 | 66.0 | 0.0 | — | — | — |
| 10 | 150 | 0.035 | octahedral | absent | present | 6.0 | 12.3 | 81.7 | 0.20 | 0.30 | — |
| 11 | 180 | 0.080 | spherical | — | present | 8.5 | 12.6 | 78.9 | 0.10 | 0.20 | — |

<Toner 1 Production Example> binder resin A (polyester resin 1) 45.0 parts binder resin B (hybrid resin 1) 55.0 parts magnetic particle 1 60.0 parts release agent 2.0 parts (C105: Fischer-Tropsch wax, melting point=105° C., Sasol)

charge control agent 2.0 parts (T-77: Hodogaya Chemical Co., Ltd.)

These materials were premixed in a Mitsui Henschel Mixer (Mitsui Miike Chemical Engineering Machinery Co., Ltd.) and were then melt kneaded using a PCM-30 twin-screw kneading extruder (Ikegai Ironworks, Ltd.) with the temperature set so as to bring the temperature of the melt at the discharge port to 150° C.

The resulting kneaded material was cooled and coarsely pulverized with a hammer mill and then finely pulverized using a Turbomill T-250 mechanical pulverizer (Turbo Kogyo Co., Ltd.). The resulting finely pulverized powder was classified using a multi-grade classifier based on the Coanda effect to obtain resin particles having a weight-average particle diameter (D4) of 7.0 μm.

This resin particle was subjected to a surface modification treatment using a Faculty surface modifier (Hosokawa Micron Corporation). Here, the peripheral rotation velocity of the dispersion rotor was 150 m/sec; the amount of resin particle introduction was 7.6 kg per 1 cycle; and the surface modification time (cycle time: the time from after the completion of starting material supply to opening of the discharge valve) was 82 seconds. The temperature when the resin particles were discharged was 44° C. The application of this step provided toner particle 1.

1.3 parts of hydrophobic silica fine particles (number-average primary particle diameter: 10 nm) provided by surface treatment with hexamethyldisilazane was added to 100.0 parts of the toner particle 1. Using the Mitsui Henschel Mixer, the obtained mixture was mixed for 10 minutes at 3,200 rpm, followed by sieving on a mesh with an aperture of 150 μm to obtain a toner 1. The properties of toner 1 are given in Table 6.

<Toners 2 to 26 Production Example>

Toners 2 to 26 were obtained as in the Toner 1 Production Example, with the exception of changing the toner formulation in the Toner 1 Production Example as shown in Table 6. The properties of toners 2 to 26 are shown in Table 6.

TABLE 6

| | | magnetic particle | | binder resin A | | binder resin B | | toner properties | | THF-soluble matter | | | | |
|---|---|---|---|---|---|---|---|---|---|---|---|---|---|---|
| | toner No. | No. | number of parts | binder resin | number of parts | binder resin | number of parts | Tg (° C.) | softening point (° C.) | Mw/Mn | Mw | Mn | proportion of a component with a molecular weight equal to or less than 1,000 (mass %) | THF-insoluble matter (mass %) |
| Example 1 | 1 | 1 | 60 | P1 | 45 | H1 | 55 | 61.2 | 115.0 | 15.0 | 55000 | 3670 | 8.5 | 6.2 |
| Example 2 | 2 | 2 | 60 | P1 | 20 | H2 | 80 | 61.4 | 114.5 | 34.4 | 117000 | 3400 | 9.3 | 19.7 |
| Example 3 | 3 | 3 | 50 | P1 | 45 | H1 | 55 | 61.0 | 112.6 | 17.0 | 68000 | 3410 | 10.8 | 6.2 |
| Example 4 | 4 | 4 | 60 | P1 | 80 | H3 | 20 | 60.8 | 112.0 | 23.0 | 71000 | 3090 | 12.0 | 5.8 |
| Example 5 | 5 | 5 | 95 | P1 | 45 | H1 | 55 | 60.9 | 114.3 | 14.0 | 49500 | 3530 | 9.1 | 6.2 |
| Example 6 | 6 | 2 | 60 | P1 | 45 | P2 | 55 | 61.3 | 114.0 | 11.5 | 46300 | 4010 | 5.8 | 3.0 |
| Example 7 | 7 | 2 | 60 | S1 | 45 | S6 | 55 | 63.1 | 127.4 | 16.0 | 75000 | 4680 | 3.5 | 6.8 |
| Example 8 | 8 | 2 | 60 | S1 | 80 | S6 | 20 | 63.2 | 111.4 | 11.0 | 44000 | 4000 | 6.5 | 2.5 |
| Example 9 | 9 | 2 | 60 | S1 | 20 | S6 | 80 | 63.0 | 136.8 | 36.0 | 124000 | 3540 | 9.0 | 20.0 |
| Example 10 | 10 | 2 | 60 | S2 | 80 | S7 | 20 | 63.2 | 96.0 | 10.5 | 34000 | 3250 | 10.0 | 2.3 |
| Example 11 | 11 | 2 | 60 | S3 | 20 | S8 | 80 | 63.0 | 143.0 | 40.0 | 144000 | 3600 | 8.1 | 23.0 |
| Example 12 | 12 | 2 | 60 | S4 | 80 | S9 | 20 | 63.2 | 91.0 | 10.3 | 32000 | 3120 | 11.2 | 2.1 |
| Example 13 | 13 | 2 | 60 | S6 | 20 | S10 | 80 | 63.0 | 145.0 | 42.0 | 154000 | 3670 | 9.6 | 24.5 |
| Example 14 | 14 | 2 | 60 | S4 | 85 | S9 | 15 | 63.2 | 89.0 | 10.3 | 31000 | 3010 | 13.7 | 2.0 |
| Example 15 | 15 | 2 | 60 | S5 | 15 | S10 | 85 | 63.0 | 148.0 | 45.0 | 164700 | 3660 | 12.2 | 24.9 |
| Example 16 | 16 | 2 | 60 | — | 0 | S11 | 100 | 61.0 | 125.0 | 10.1 | 34300 | 3400 | 12.7 | 2.0 |
| Example 17 | 17 | 2 | 60 | — | 0 | S12 | 100 | 63.0 | 148.0 | 69.0 | 165500 | 2400 | 14.7 | 26.0 |
| Example 18 | 25 | 2 | 60 | — | 0 | S14 | 100 | 63.0 | 113.1 | 10.0 | 33000 | 3300 | 13.3 | 1.1 |
| Example 19 | 26 | 2 | 60 | — | 0 | S15 | 100 | 63.0 | 145.0 | 70.0 | 161700 | 2310 | 15.0 | 28.0 |
| Comparative Example 1 | 18 | 7 | 60 | S2 | 80 | S7 | 20 | 63.2 | 96.0 | 10.2 | 33600 | 3300 | 10.9 | 1.9 |
| Comparative Example 2 | 19 | 8 | 60 | S2 | 80 | S7 | 20 | 63.2 | 96.0 | 10.2 | 33300 | 3300 | 10.5 | 1.9 |
| Comparative Example 3 | 20 | 9 | 60 | S2 | 80 | S7 | 20 | 63.2 | 96.0 | 10.2 | 33300 | 3330 | 9.8 | 1.9 |
| Comparative Example 4 | 21 | 10 | 60 | S2 | 80 | S7 | 20 | 63.2 | 96.0 | 10.2 | 33300 | 3280 | 10.5 | 1.9 |
| Comparative Example 5 | 22 | 11 | 60 | S2 | 80 | S7 | 20 | 63.2 | 96.0 | 10.2 | 32800 | 3280 | 10.6 | 1.9 |
| Comparative Example 6 | 23 | 6 | 60 | S2 | 80 | S7 | 20 | 63.2 | 96.0 | 10.2 | 32300 | 3200 | 10.7 | 1.9 |
| Comparative Example 7 | 24 | 2 | 60 | — | 0 | S13 | 100 | 60.5 | 112.0 | 7.8 | 42000 | 5400 | 3.0 | 0.0 |

Example 1

Toner 1 was evaluated as follows. The results of the evaluation are given in Table 7.

[Evaluation of the Low-Temperature Fixability]

For the low-temperature fixability, the fixing unit of a laser beam printer (HP LaserJet Enterprise M603dn, Hewlett-Packard Company) was removed to the outside and the temperature of the fixing unit was made freely settable; the external fixing unit used was modified to give a process speed of 400 mm/sec. Plover Bond paper (105 g/m$^2$, Fox River Paper Company) was used for the evaluation paper.

Using this apparatus, the temperature of the fixing unit was changed in 5° C. increments in the range from 150° C. to 220° C. in a normal-temperature, normal-humidity environment (temperature=23.5° C., humidity=60% RH), and an unfixed image was fed through at each temperature.

The toner laid-on level for this unfixed image was adjusted to provide an image density for the fixed image of 0.67 to 0.73.

At each temperature, the obtained fixed image was rubbed in 5 back-and-forth excursions with lens-cleaning paper loaded with 4.9 kPa (50 g/cm$^2$), and the decline in the image density pre-versus-post-rubbing (the rubbing density decline [%]) was determined. The low-temperature fixability was evaluated using the lowest fixation temperature at which the rubbing density decline [%] was equal to or less than 15.0% (the fixation temperature lower limit).

The image density was measured using a MacBeth densitometer (MacBeth Corporation), which is a reflection densitometer, and using an SPI filter.

(Evaluation Criteria)

A: the fixation temperature lower limit is less than 160° C.

B: the fixation temperature lower limit is at least 160° C. and less than 180° C.

C: the fixation temperature lower limit is at least 180° C. and less than 200° C.

D: the fixation temperature lower limit is at least 200° C.

C or better is acceptable for the present invention.

[Evaluation of the Fixing Margin]

For the low-temperature fixability, the fixing unit of a laser beam printer (HP LaserJet Enterprise M603dn, Hewlett-Packard Company) was removed to the outside and the temperature of the fixing unit was made freely settable; the external fixing unit used was modified to give a process speed of 200 mm/sec.

PB Paper (Canon Marketing Japan Inc., areal weight=66 g/cm$^2$, letter) was used for the evaluation paper.

Using this apparatus, the temperature of the fixing unit was changed in 5° C. increments in the range from 150° C. to 220° C. in a normal-temperature, normal-humidity environment (temperature=23.5° C., humidity=60% RH), and an unfixed image was fed through at each temperature.

This unfixed image had a 5 mm leading edge margin above it; a 15 mm×15 mm patch image was formed; and the toner laid-on level was adjusted to provide a patch image density of 0.67 to 0.73.

Using the fixed image obtained at each temperature, the reflectance of the white background of the paper was measured and the worst value was determined and its difference from the reflectance of a standard paper was determined. The highest fixation temperature (fixation temperature upper limit) at which this difference was equal to or less than 3.0% was determined.

The fixing margin was evaluated based on the difference between the fixation temperature lower limit and the fixation temperature upper limit described above.

(Evaluation Criteria)

A: the fixing margin is at least 50° C.

B: the fixing margin is at least 30° C. and less than 50° C.

C: the fixing margin is at least 10° C. and less than 30° C.

D: the fixing margin is less than 10° C.

C or better is acceptable for the present invention.

[Evaluation of Image Quality After Standing Under Harsh Conditions]

The machine used for the evaluation was a laser beam printer (HP LaserJet Enterprise M603dn, Hewlett-Packard Company) with a modified main unit and cartridge (Hewlett-Packard Company).

The main unit of the HP LaserJet Enterprise M603dn was modified to a process speed of 400 mm/sec, which was higher than the original process speed.

The developing sleeve was exchanged for a developing sleeve with a diameter of 10 mm, which was a smaller diameter than for the original developing sleeve.

1,100 g of toner, which was larger than the product fill level, was introduced into the cartridge and the fill density was thus brought to 0.67 g/cm$^3$ (1.3-times normal).

This cartridge was held for 30 days under a harsh high-temperature, high-humidity environment at a temperature of 40° C. and a humidity of 95% RH (referred to below as the harsh conditions).

The cartridge was then removed and an image output test was run in a high-temperature, high-humidity environment (32.5° C., 85% RH), which is an environment in which there is a high adhesive force in the toner and is thus a rigorous environment with respect to toner aggregation clumps.

In addition, the initial halftone image is the most rigorous condition with regard to the decline in image quality caused by toner aggregates.

Due to this, an initial 10 prints of a halftone image were made and the number of white specks, i.e., where the density was weaker than in other areas, was counted in this halftone image, and the image quality after standing under harsh conditions was then evaluated based on the maximum value for the number of N these specks.

(Evaluation Criteria)

A: white specks are not present

B: the maximum number of white specks is 1 to 3

C: the maximum number of white specks is 4 or 5

D: the maximum number of white specks is 6 or more

C or better is acceptable for the present invention.

[Evaluation of Image Fogging After Standing Under Harsh Conditions]

After the aforementioned evaluation of the image quality after standing in a harsh environment, an image output test was run under high-temperature, high-humidity conditions (32.5° C., 85% RH). 10,000 prints per day were made of a horizontal line pattern having a print percentage of 4%, using 2 prints/1 job and using a mode in which the machine was temporarily stopped between jobs and the next job was then begun; a total of 30,000 prints were made in 3 days.

After this, the cartridge that had been used in this print durability evaluation was held for 1 day in a low-temperature, low-humidity environment (15.0° C., 10% RH), followed by an evaluation of the fogging in this same environment. In a low-temperature, low-humidity environment, the toner is more easily charged and the charge distribution becomes broader and fogging is thus more readily produced, and as a consequence the evaluation becomes more rigorous.

To test the fogging, in specific terms a solid white image was output and its reflectance was measured using a Reflectometer Model TC-6DS from Tokyo Denshoku Co., Ltd. The reflectance was similarly also measured on the transfer paper (standard paper) prior to formation of the solid white image. A green filter was used for the filter. The fogging was calculated using the following formula from the reflectance prior to the output of the solid white image and after the output of the solid white image.

fogging (reflectance) (%)=reflectance of the standard paper (%)−reflectance of the white image sample (%)

The criteria for scoring the fogging are as follows.

A: very good (less than 1.0%)

B: good (at least 1.0% and less than 1.5%)

C: average (at least 1.5% and less than 2.5%)

D: poor (at least 2.5%)

C or better is acceptable for the present invention.

[Evaluation of the Image Density]

A modified laser beam printer (HP LaserJet Enterprise M603dn, Hewlett-Packard Company) and a modification of the prescribed cartridge (Hewlett-Packard Company) were used for the evaluation machine. The main unit of the HP LaserJet Enterprise M603dn was modified to 450 mm/s, which was faster than the original process speed. In addition, the developing sleeve was replaced with one with a diameter of 10 mm, which was a smaller diameter than for the original developing sleeve. 1,100 g of toner, which was larger than the product fill level, was introduced into the cartridge. Accompanying this, the stirring blade was enlarged in order to improve the toner circulation.

An ordinary letter size paper (Xerox 4200, Xerox Corporation, 75 g/m$^2$) was used for the evaluation paper.

Using this main unit and cartridge, an image output test was run of 10,000 prints per day of a horizontal line pattern having a print percentage of 4%, using 2 prints/1 job and using a mode in which the machine was temporarily stopped between jobs and the next job was then begun; a total of 30,000 prints were made in 3 days. The image density was performed at the 30,000th print, which is a rigorous condition of maximum reduction.

The evaluation was performed in a high-temperature, high-humidity environment (32.5° C., 85% RH), which causes a decline in the charging characteristics of the toner and is thus a more rigorous condition for image output.

The image density was measured by measuring the reflection density of a round 5 mm solid black image using a MacBeth densitometer (MacBeth Corporation), which is a reflection densitometer, and using an SPI filter. A larger numerical value indicates a better developing performance. The specific evaluation criteria are as follows.

(Evaluation Criteria)

A: very good (at least 1.45)

B: good (at least 1.40 and less than 1.45)

C: average (at least 1.35 and less than 1.40)

D: poor (less than 1.35)

Examples 2 to 19 and Comparative Examples 1 to 7

The same evaluations as in Example 1 were performed, with the exception of using toners 2 to 26. The evaluation results are given in Table 7.

TABLE 7

| | | results of the evaluations | | | | | | | | | | |
|---|---|---|---|---|---|---|---|---|---|---|---|---|
| | toner No. | low-temperature fixability | | fixing margin | | image quality after standing under harsh conditions | | image fogging after standing under harsh conditions | | image density | | |
| Example 1 | 1 | A | 155 | A | 55 | A | 0 | A | 0.3 | A | 1.52 |
| Example 2 | 2 | A | 155 | A | 55 | A | 0 | A | 0.4 | A | 1.52 |
| Example 3 | 3 | A | 155 | A | 55 | A | 0 | A | 0.5 | A | 1.52 |
| Example 4 | 4 | A | 155 | A | 55 | A | 0 | A | 0.7 | A | 1.52 |
| Example 5 | 5 | A | 155 | A | 55 | A | 0 | A | 0.7 | A | 1.52 |
| Example 6 | 6 | A | 155 | A | 55 | B | 1 | B | 1.0 | A | 1.52 |
| Example 7 | 7 | B | 165 | B | 40 | B | 1 | B | 1.0 | A | 1.52 |
| Example 8 | 8 | B | 165 | B | 40 | B | 1 | B | 1.1 | A | 1.52 |
| Example 9 | 9 | B | 165 | B | 40 | B | 1 | B | 1.2 | A | 1.52 |
| Example 10 | 10 | B | 165 | B | 40 | B | 1 | B | 1.2 | B | 1.44 |
| Example 11 | 11 | B | 165 | B | 40 | B | 1 | B | 1.3 | B | 1.44 |
| Example 12 | 12 | B | 165 | B | 30 | B | 3 | C | 1.5 | B | 1.42 |
| Example 13 | 13 | B | 175 | B | 40 | B | 3 | C | 1.6 | B | 1.42 |
| Example 14 | 14 | B | 165 | C | 25 | C | 4 | C | 1.7 | B | 1.41 |
| Example 15 | 15 | C | 190 | B | 40 | C | 5 | C | 1.9 | B | 1.41 |
| Example 16 | 16 | B | 165 | C | 25 | C | 5 | C | 2.0 | B | 1.41 |
| Example 17 | 17 | C | 190 | B | 40 | C | 5 | C | 2.1 | B | 1.41 |
| Example 18 | 25 | B | 165 | C | 10 | C | 5 | C | 2.3 | C | 1.37 |
| Example 19 | 26 | C | 195 | B | 45 | C | 5 | C | 2.3 | C | 1.36 |
| Comparative Example 1 | 18 | D | 200 | D | −10 | D | 15 | D | 2.7 | D | 1.32 |
| Comparative Example 2 | 19 | D | 200 | D | −10 | D | 15 | D | 2.8 | D | 1.31 |
| Comparative Example 3 | 20 | D | 200 | D | −10 | D | 16 | D | 2.9 | D | 1.31 |
| Comparative Example 4 | 21 | D | 200 | D | −10 | D | 17 | D | 3.3 | D | 1.31 |
| Comparative Example 5 | 22 | D | 200 | D | −10 | D | 17 | D | 3.1 | D | 1.31 |
| Comparative Example 6 | 23 | D | 200 | D | −10 | D | 22 | D | 3.1 | D | 1.31 |
| Comparative Example 7 | 24 | D | 210 | D | −30 | D | 12 | D | 2.5 | D | 1.20 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002481, filed Jan. 8, 2016, which is hereby incorporated by reference herein in its entirety.

What is claimed is:

1. A toner having a toner particle that contains a binder resin and a magnetic particle, wherein the magnetic particle satisfies all of the stipulations (i) to (iii) below:

(i) the magnetic particle has an octahedral shape having a protruded portion on a plane portion thereof, (ii) the magnetic particle comprises a core particle that contains magnetite, with a coating layer provided on a surface of the core particle, and (iii) the coating layer contains an iron-containing oxide and at least one material selected from the group consisting of a silicon-containing oxide and an aluminum-containing oxide, and the ratio (Mw/Mn) of a weight-average molecular weight (Mw) to a number-average molecular weight (Mn) is at least 10.0 in a molecular weight distribution measured on the tetrahydrofuran (THF)-soluble matter of the toner using gel permeation chromatography (GPC).

2. The toner according to claim 1, wherein the number-average primary particle diameter (D1) of the magnetic particle is 50 to 200 nm.

3. The toner according to claim 1, wherein the total pore volume of the magnetic particle is 0.060 to 0.150 $cm^3/g$.

4. The toner according to claim 1, wherein the content of resin component insoluble in tetrahydrofuran (THF) in the binder resin is 2.0 to 25.0 mass %.

5. The toner according to claim 1, wherein, in the molecular weight distribution measured on the tetrahydrofuran (THF)-soluble matter of the toner using gel permeation chromatography (GPC), the proportion of a component with a molecular weight of equal to or less than 1,000 in the THF-soluble matter is 3.5 to 12.0 mass %.

6. The toner according to claim 1, wherein the binder resin contains a binder resin A having a softening point (TA) of 80.0° C. to 100.0° C., and a binder resin B having a softening point (TB) of 120.0° C. to 160.0° C.

7. The toner according to claim 6, wherein the mass ratio of binder resin A to binder resin B is 20:80 to 80:20.

8. The toner according to claim 6, wherein binder resin B is a hybrid resin in which a polyester segment is chemically bonded to a vinyl polymer segment.

9. The toner according to claim 1, wherein the height of the protruded portion present on the magnetic particle is 1 to 40 nm.

10. The toner according to claim 9, wherein the height of the protruded portion present on the magnetic particle is 7 to 20 nm.

* * * * *